US011667362B2

(12) United States Patent
Armani et al.

(10) Patent No.: US 11,667,362 B2
(45) Date of Patent: Jun. 6, 2023

(54) DIVING MASK PROVIDED WITH A TELECOMMUNICATIONS DEVICE

(71) Applicant: DECATHLON, Villeneuve d'Ascq (FR)

(72) Inventors: Stéphane Armani, Villefranque (FR); Antoine Ravise, Lille (FR); Olivia Meillassoux, Hendaye (FR); Grégoire Hembert, Hendaye (FR)

(73) Assignee: DECATHLON, Villeneuve d'Ascq (FR)

( * ) Notice: Subject to any disclaimer, the term of this patent is extended or adjusted under 35 U.S.C. 154(b) by 1374 days.

(21) Appl. No.: 15/568,002

(22) PCT Filed: Apr. 15, 2016

(86) PCT No.: PCT/FR2016/050890
§ 371 (c)(1),
(2) Date: Oct. 20, 2017

(87) PCT Pub. No.: WO2016/170253
PCT Pub. Date: Oct. 27, 2016

(65) Prior Publication Data

US 2018/0134352 A1 May 17, 2018

(30) Foreign Application Priority Data

Apr. 21, 2015 (FR) ..... 15 53577

(51) Int. Cl.
*B63C 11/26* (2006.01)
*B63C 11/16* (2006.01)
*A62B 18/08* (2006.01)

(52) U.S. Cl.
CPC ..... *B63C 11/26* (2013.01); *A62B 18/08* (2013.01); *B63C 11/16* (2013.01)

(58) Field of Classification Search
CPC ..... B63C 11/00; B63C 11/02; B63C 11/12; B63C 11/14; B63C 11/16; B63C 11/165;
(Continued)

(56) References Cited

U.S. PATENT DOCUMENTS 2,456,130 A 12/1948 Lambertsen
3,218,607 A * 11/1965 Brock ..... H04M 1/05 367/132
(Continued)

FOREIGN PATENT DOCUMENTS

CN 2901757 Y 5/2007
CN 201846340 U 5/2011
(Continued)

*Primary Examiner* — Annette Dixon
(74) *Attorney, Agent, or Firm* — Bookoff McAndrews, PLLC

(57) ABSTRACT

The invention relates to a diving mask (10) including a frame (12) fitted with a visor (18);

a flexible skirt (40) including a partition (46) delimiting an upper chamber (50) for viewing from a lower chamber (52) for breathing, the partition being arranged to bear upon the nose of the user such that the mouth and the nose of the user are in the lower chamber, while the eyes of the user are in the upper chamber, a breathing tube (20) having a proximal end (20*a*) for linking the breathing tube to the frame, the breathing tube including at least one channel (21) fluidically connected with the lower chamber.

The diving mask further includes a telecommunications device (500) which is mounted at least partially to the breathing tube (20).

33 Claims, 18 Drawing Sheets

(58) Field of Classification Search
CPC ..... B63C 11/18; B63C 11/20; B63C 11/202; B63C 11/205; B63C 11/207; B63C 11/26; B63C 2011/121; B63C 2011/123; B63C 2011/125; B63C 2011/126; B63C 2011/128; B63C 2011/165; A41D 13/0025; A41D 13/1153; A41D 13/1163; A41D 13/1184; A41D 13/1209; A41D 13/1218; A42B 3/225; A42B 3/286; A42B 3/30; A42B 3/322; A61B 90/05; A61F 9/026; A61F 9/027; A61K 31/295; A61K 33/26; A61M 16/06; A62B 17/04; A62B 18/00; A62B 18/003; A62B 18/045; A62B 18/08; A62B 18/10; A62B 9/02; A63B 33/00; A63B 33/002; C07C 51/41; C07C 51/412; C07C 51/418; C07C 59/265; C07F 15/02; C07F 15/025; F16K 15/144; F16K 15/16; F16K 27/0209; F16M 13/04; G03B 17/08; G03B 17/561; G03B 17/566; G03B 29/00; G01K 11/22; G10L 2021/03643; H04B 10/116; H04B 10/502; H04B 10/541; H04B 10/66; H04B 13/00; H04B 13/02
See application file for complete search history.

(56) References Cited

U.S. PATENT DOCUMENTS

| | | | | | |
|---|---|---|---|---|---|
| 4,276,877 | A * | 7/1981 | Gdulla | A62B 18/00 | 128/204.26 |
| 5,209,226 | A | 5/1993 | Goodley | | |
| 5,245,993 | A | 9/1993 | McGrady et al. | | |
| 5,606,967 | A * | 3/1997 | Wang | B63C 11/16 | 128/200.29 |
| 6,430,298 | B1 * | 8/2002 | Kettl | A62B 18/08 | 381/361 |
| 6,626,178 | B2 | 9/2003 | Morgan et al. | | |
| 7,310,063 | B1 * | 12/2007 | Brown | B63C 11/26 | 342/357.75 |
| 2006/0009970 | A1 * | 1/2006 | Harton | 704/231 | |
| 2013/0156246 | A1 * | 6/2013 | Menyhart | A62B 18/08 | 381/367 |
| 2015/0217143 | A1 * | 8/2015 | Palmer | A62B 18/08 | 128/202.27 |
| 2018/0134352 | A1 | 5/2018 | Armani et al. | | |

FOREIGN PATENT DOCUMENTS

| | | | | | |
|---|---|---|---|---|---|
| CN | 202295264 | U | 7/2012 | | |
| CN | 103129722 | A | 6/2013 | | |
| CN | 103380054 | A | 10/2013 | | |
| CN | 204173146 | U | 2/2015 | | |
| FR | 1377066 | A | 10/1964 | | |
| FR | 2650987 | A1 * | 2/1991 | B63C 11/26 | |
| FR | 2720050 | A1 * | 11/1995 | B63C 11/16 | |
| FR | 2720050 | A1 | 11/1995 | | |
| JP | 2005212632 | A | 8/2005 | | |
| JP | 2006306339 | A | 11/2006 | | |
| WO | 95/09676 | A1 | 4/1995 | | |
| WO | WO98/03225 | A1 | 1/1998 | | |
| WO | WO-9803225 | A1 * | 1/1998 | B63C 11/14 | |
| WO | WO-0045895 | A1 * | 8/2000 | A62B 18/08 | |

* cited by examiner

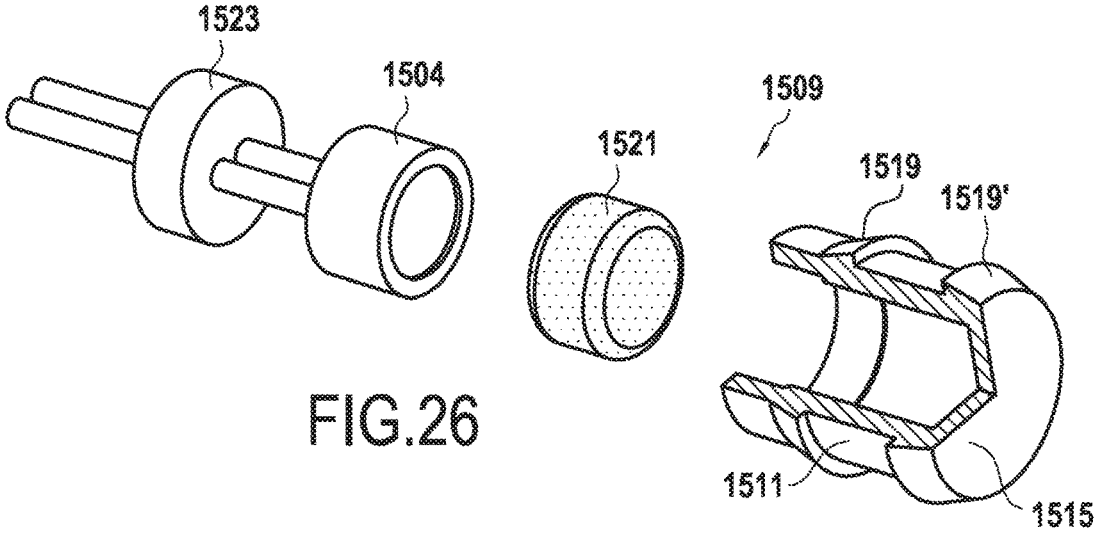
FIG.26
FIG.27
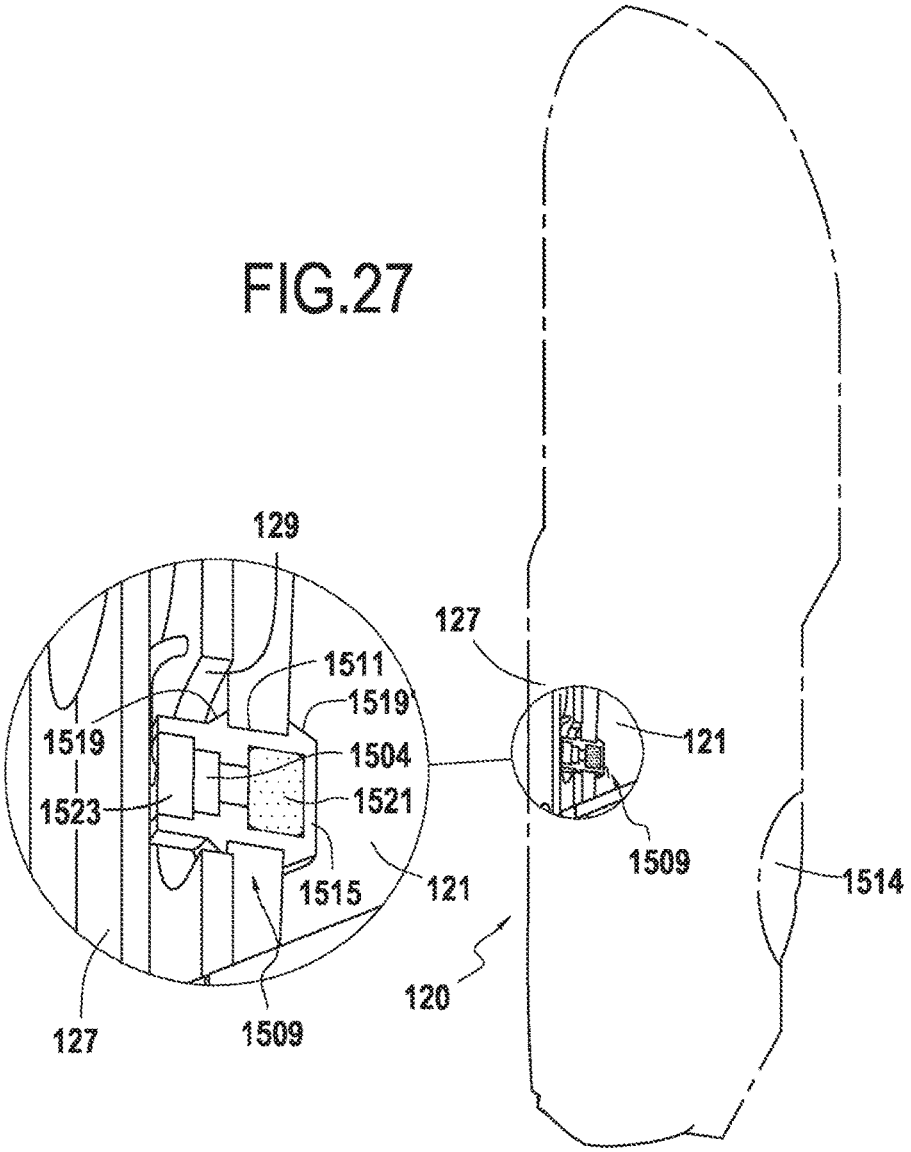

DIVING MASK PROVIDED WITH A TELECOMMUNICATIONS DEVICE

BACKGROUND OF THE DISCLOSURE

The present disclosure relates to the field of diving masks, and especially masks used for "snorkelling".

This snorkelling activity observes the seabed whilst swimming on the surface of the water. The snorkeller must be able to hold his head under water whilst breathing.

Generally, the snorkeller is equipped with a mask for viewing and a snorkel for breathing. The snorkel includes a tube whose lower end is equipped with a mouthpiece which fits into the user's mouth, and an upper end which allows both the intake of fresh air and the exhaust of expired air.

It is known that such equipment has numerous disadvantages. First, since breathing via the mouth is not natural, some persons have difficulty breathing orally through a snorkel. Another disadvantage is that it is not possible to talk underwater when wearing a snorkel.

Also, the use of this mask-snorkel device is therefore not very comfortable.

To overcome this drawback, document FR 2 720 050 proposes a diving mask with which it is possible to breathe through the nose and through the mouth.

Such a diving mask includes:

a frame fitted with a visor;

a flexible skirt including a partition delimiting an upper chamber for viewing from a lower chamber for breathing, the partition being arranged to bear upon the top of the user's nose so that the user's mouth and nose are positioned in the lower chamber, whilst the user's eyes are positioned in the upper chamber, a breathing tube having a proximal end for linking the breathing tube to the frame, and a distal end opposite the proximal end, the breathing tube including at least one channel fluidically connected with the lower chamber.

By way of this mask, the user, who has his mouth free, can now speak. Document FR 2 720 050 further provides that the lower part of the visor of the mask has a wall a little more finely honeycombed so as to fulfil the function of a membrane and allow the passage of sounds in water. Such an arrangement however does not allow communicating with other snorkellers several metres away, or else with a person remained on the shore, while having his head under water.

SUMMARY OF THE DISCLOSURE

It is one objective of the disclosure to propose a diving mask of the above type for communicating comfortably with other snorkellers at a distance.

The disclosure attains this objective through the fact that the mask further includes a telecommunications device which is mounted at least partially to the breathing tube.

Breathing tube means especially, but not exclusively, a snorkel having an open distal end. The breathing tube can also be a tube connected to a compressed air source.

The breathing tube may extend from an upper part of the frame. However, according to a variant, said breathing tube extends from a lower part of the frame or the visor. According to another variant, the diving mask according to the disclosure includes several breathing tubes.

Telecommunications device means an electronic device which transmits and/or receives a signal such as a radio signal or even ultrasound.

The telecommunications device according to the disclosure may utilize wireless communication technology. The telecommunications device may utilize "Bluetooth®" technology known also, especially in the computing industry.

The inventors have noted that this technology lets snorkellers communicate between each other when apart by several tens of metres.

According to a variant, this is ultrasound technology which makes it possible to communicate under water. According to another variant, at the same time the telecommunications device runs "Bluetooth®" technology and ultrasound technology, and does this to substantially improve the listening quality of the mask when the user is completely immersed.

The telecommunications device may be arranged to permit communicating with several users at the same time.

An interest of the disclosure is that snorkellers fitted with masks according to the disclosure can communicate with each other at a distance; this results in moments of pleasure and sharing during snorkelling.

Another interest of the disclosure is that it enables safe snorkelling with a child, where the child remains in permanent communication with the adult, irrespective of his/her location in the water.

Embodiments of the disclosure may also aid in coaching snorkellers, with the instructor easily able to give instructions to a group of snorkellers.

Finally, the snorkeller equipped with the diving mask according to the disclosure can also stay in contact and communicate with a person remained on the shore or on a boat.

According to the disclosure, the telecommunications device is mounted at least partially to the breathing tube.

"Mounted" means that the telecommunications device is fixed at least partially to the breathing tube, detachably or not. This includes especially the case, non-limiting, wherein the telecommunications device is housed in the breathing tube during manufacturing of said tube. This includes especially the case, non-limiting, wherein a section of the telecommunications device belongs to the breathing tube, whereas another section of the telecommunications device belongs to the frame or the visor of the mask.

This arrangement may avoid crowding the area of the mask located in front of the mouth of the user.

Yet another interest is that the telecommunications device is arranged near the surface of the water, for easy transmission and reception of the radio signal.

Embodiments of the disclosure may enable the telecommunications device to capture the sounds emitted by the user via the breathing tube, as a result of which it is not necessary to place a microphone near the mouth of the user.

At least one part, the first part, of the telecommunications device may be arranged at the proximal end of the breathing tube.

Proximal end means that of the two ends of the breathing tube which is the closest to the frame of the mask.

An interest of this arrangement is being able to place some electronic components most closely to the user so that the centre of gravity of the mask is not shifted towards the distal end of the breathing tube.

Another interest is being able to place some components, such as for example a microphone, as close as possible to the user.

According to an embodiment, the telecommunications device is housed in a case which is mounted with the breathing tube, for example by clipping, or any other detachable fastening means.

The first part may include a microphone and/or a loudspeaker.

Due to the proximal arrangement of the microphone, the latter more easily captures the sound waves originating from the mouth of the user and which move in the breathing tube.

To improve the quality of the sound information sensed by the microphone, the first part includes a microphone which leads in the channel.

Also, a proximal arrangement of the loudspeaker ensures hearing comfort.

At least one part, the second part, of the telecommunications device may be arranged at the distal end of the breathing tube.

Distal end means the end of the breathing tube which is opposite the proximal end. This is therefore the end of the breathing tube which is away from the frame and which generally surfaces when the breathing tube is a snorkel.

The second part may include an antenna.

As the distal end of the breathing tube is most often surfaced, the same applies for the antenna, which favours transmission and reception of radio signals.

The second part may include transmitter and/or receiver modules for transmitting and/or receiving radio signals.

At least one part, the third part, of the telecommunications device may be mounted to the frame.

The third part can also be mounted to the visor.

According to some embodiments, the third part may be integrated to the frame or the visor and is electrically connected to the first part and/or to the second part of the telecommunications device. When the third part is present, the breathing tube may form one and the same piece with the frame or the visor.

The third part may include at least one control button of the telecommunications device. The button can be an on/off button, or can be a button for adjusting the sound volume. The third part may include several buttons and control elements linked to said buttons for controlling the telecommunications device.

In an embodiment, the third part includes at least one loudspeaker which can be integrated to the frame or the visor. However, the loudspeaker may be connected to the frame by a linking arm so that the loudspeaker can be placed as close as possible to one of the ears of the user. According to a variant, a second loudspeaker may be provided, for example, connected to the frame by another linking arm so that the second loudspeaker is arranged near the other ear of the user.

According to another embodiment, the telecommunications device includes at least one loudspeaker shifted relative to the body of the breathing tube so as to be placed near at least one of the ears of the user.

According to another variant, the telecommunications device includes one—possibly two—shifted loudspeaker(s) consisting of an intra-auricular earpiece connected to the breathing tube by a flexible cable which may be detachable from the breathing tube.

According to a first embodiment of the disclosure, the breathing tube may form one and the same piece with the frame. In this first embodiment, the breathing tube is not detachable from the frame or of the visor. If appropriate, it can easily have cables pass through it to connect the first or second part of the telecommunications device mounted to the breathing tube with the third part of the telecommunications device mounted to the frame or to the visor.

In this first embodiment, the breathing tube may extend from an upper part of the frame, and the telecommunications device includes an antenna arranged in the lower part of the frame. This antenna may be arranged in the lower part of the frame is an ultrasound antenna configured to transmit and/or receive ultrasound. As the lower part of the frame is most often immersed, the ultrasound antenna is also immersed, ensuring transmitting and receiving of ultrasound by the telecommunications device.

According to a second embodiment of the disclosure, the breathing tube may be detachable from the frame, and the breathing tube may include the telecommunications device.

In this second embodiment, the whole telecommunications device is preferably integrated into the breathing tube.

An interest is to reduce the bulk of the mask when it is not being used. Another interest is to be able to easily change the telecommunications device, for example in case of breakdown or during a technological evolution, without having to change diving mask. Yet another interest is being able to change the mask size while keeping its breathing tube fitted with the telecommunications device.

The antenna may be arranged at the distal end of the breathing tube.

According to a third embodiment of the disclosure, said diving mask further includes a detachable connector arranged to be mounted to the breathing tube and to the frame such that the detachable connector, when it is mounted to the breathing tube and the frame, forms a fluidic connection at least between the lower chamber and the channel of the breathing tube, the detachable connector being detachable from the frame and the breathing tube, and wherein the detachable connector includes the telecommunications device.

This detachable connector constitutes an intermediate piece to be inserted between the frame of the mask and the breathing tube. It is understood that when the detachable connector is mounted to the breathing tube the telecommunications device is also mounted to the breathing tube, according to the disclosure.

The detachable connector ensures passage of air between at least the lower chamber and the breathing tube.

The telecommunications device may include a loudspeaker housed in the detachable connector.

However, according to some embodiments, the telecommunications device may include at least one shifted loudspeaker which is arranged to be disposed facing one of the ears of the user. An interest is to improve the hearing quality by having the loudspeaker as close as possible to the ear of the user. To improve the hold of the loudspeaker the frame includes a fastening element for holding the shifted loudspeaker.

According to another variant, the detachable connector includes a linking arm supporting the shifted loudspeaker, the linking arm extending according to a lateral side of the diving mask. The linking arm may have the same curvature as the lateral side of the mask and borders the frame so as not to oppose hydrodynamic resistance.

According to another variant, the telecommunications device includes one—possibly two—shifted loudspeaker(s) including an intra-auricular earpiece connected to the detachable connector by a flexible cable which may be detachable from the detachable connector.

The telecommunications device may include an antenna which is disposed in a joining element configured to extend along the breathing tube, said joining element having an end arranged to be fixed to the distal end of the breathing tube.

The joining element includes an electrical linking wire connecting the antenna to the other electronic components of the telecommunications device arranged in the detachable connector.

The breathing tube may include a fastening member, while the frame includes a fastening device arranged to be able to be detachably fixed to the fastening member of the breathing tube so as to be able to form a sealed connection between the breathing tube and the frame, and wherein the detachable connector includes a first fastening part arranged to be detachably fixed with the fastening member of the breathing tube, and a second fastening part arranged to be able to be detachably fixed with the fastening device of the frame, so as to be able to form a first sealed connection between the breathing tube and the detachable connector, and a second sealed connection between the frame and the detachable connector.

It is understood therefore that the breathing tube can be directly connected to the frame of the diving mask when the detachable connector is detached, due to which the diving mask according to the disclosure can also be used without the telecommunications device.

According to some embodiments of the diving mask, the partition includes at least one passageway for enabling a circulation of inspired air directed from the upper chamber towards the lower chamber during an inspiration phase of the user, and wherein the breathing tube has an inspired air intake channel and at least one first expired air exhaust channel, such that when said breathing tube is fluidically connected with the frame, the inspired air intake channel is fluidically connected with the upper chamber, while the first expired air exhaust channel is fluidically connected with the lower chamber.

Such an arrangement evacuates humidity out of the upper chamber, due to which the appearance of condensation on the inner wall of the visor may be avoided.

According to a variant of the third embodiment, the detachable connector includes an inspired air intake duct and at least one first expired air exhaust duct, and when the detachable connector, the breathing tube and the frame are mounted together, the inspired air intake duct of the detachable connector fluidically connects the inspired air intake channel of the breathing tube to the upper chamber, while the first expired air exhaust duct of the detachable connector fluidically connects the lower chamber to the first expired air exhaust channel.

The disclosure further relates to a detachable connector of a diving mask according to the disclosure, said connector including at least one duct, wherein, when the detachable connector is fixed to the diving mask, the duct fluidically connects the breathing tube to the lower chamber, and the detachable connector includes a telecommunications device.

The detachable connector may be that of the third embodiment of the diving mask.

The disclosure finally relates to a detachable breathing tube of a diving mask according to the second embodiment of the disclosure, the breathing tube including a fastening part for its detachable fastening to the frame of the mask, and a telecommunications device.

The telecommunications device of the detachable connector and of the detachable breathing tube includes the technical characteristics defined earlier.

BRIEF DESCRIPTION OF THE DRAWINGS

The disclosure will be more clearly understood from the following description of embodiments of the disclosure given by way of non-limiting examples, in reference to the appended drawings, wherein:

FIGS. 26 and 27 illustrate a case for a microphone configured to be mounted on a breathing tube such as illustrated in FIGS. 6A to 6C.

DETAILED DESCRIPTION OF THE DISCLOSURE

First, it is specified that visor means the face screen through which the user can see objects external to the mask. Frame means the peripheral part of the diving mask which supports the above face screen, the flexible skirt being, for example, fixed to the frame.

According to the disclosure, the frame can form a single piece with the visor, wherein case the frame consists of the peripheral portion of the visor. In the latter case, the flexible skirt may be fixed to the frame constituted by the peripheral portion of the visor. The frame can also be in several parts, for example a first part forming a single piece with the visor and a second part fixed about the first part. In the latter case, the flexible skirt can be fixed to the first part of the frame.

Figure 1:
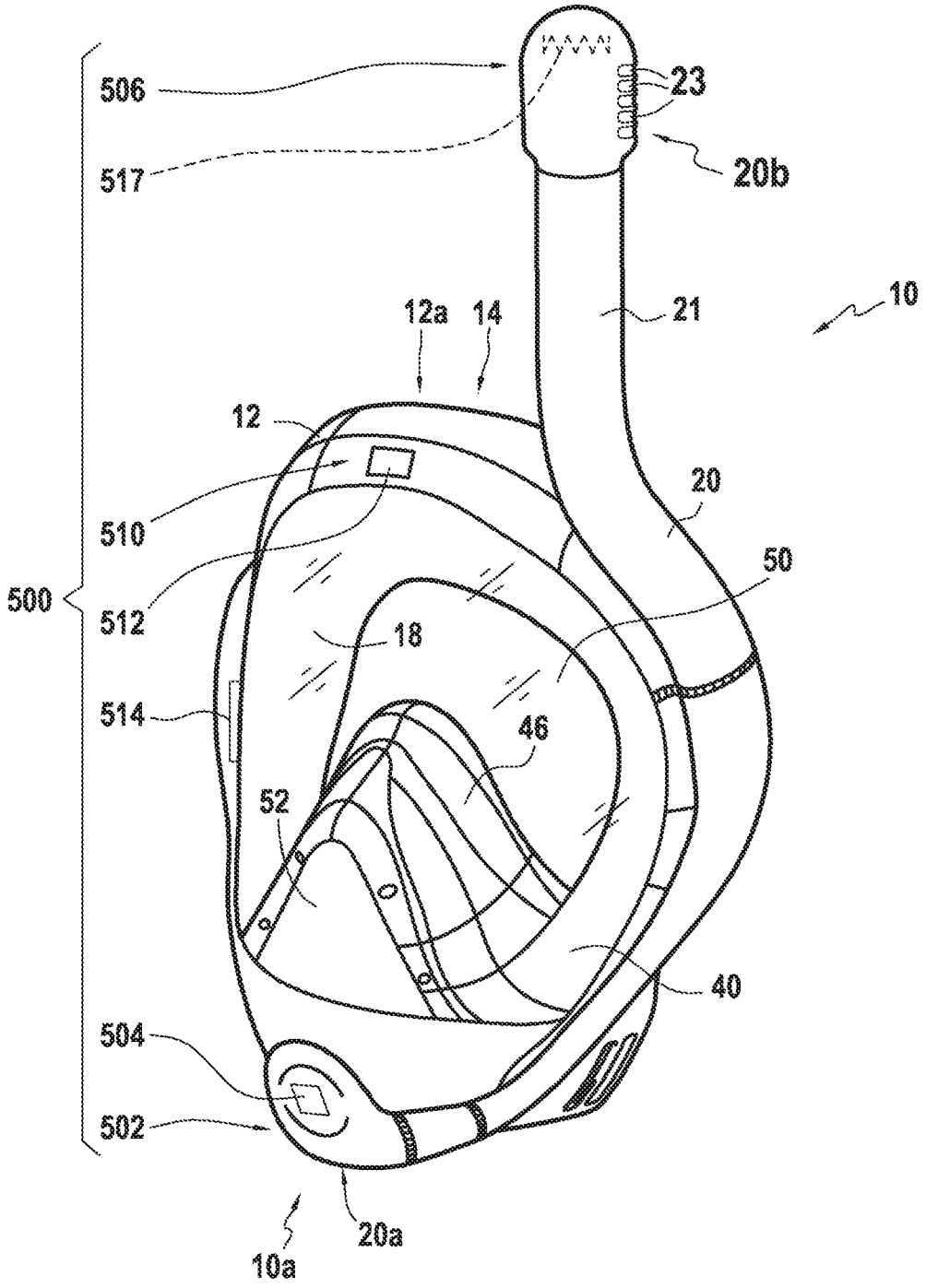
FIG. 1 is a perspective view of a diving mask according to the first embodiment of the disclosure, wherein the breathing tube is a snorkel which extends from the lower part of the frame.

FIG. 1 illustrates an example of a diving mask 10 according to a first embodiment of the disclosure. This diving mask 10 includes a frame 12 fitted with a visor 18, and a flexible skirt 40 integral with the frame. The flexible skirt includes a partition 46 which delimits an upper chamber 50 for viewing from a lower chamber 52 for breathing. The partition 46 is arranged to bear upon the nose of the user such that the mouth and the nose of the user are in the lower chamber 52, while the eyes of the user are in the upper chamber 50.

The diving mask 10 further includes a breathing tube 20 which comprises a proximal end 20*a* for linking the breathing tube 20 to the frame 12, and a distal end 20*b* which is opposite the proximal end 20*a*.

In the example of FIG. 1, the proximal end 20*a* of the breathing tube 20 extends from a lower part 10*a* of the diving mask 10. The proximal end 20*a* of the breathing tube 20, in this example, traverses the lower part of the frame to terminate in the lower chamber 52. Without departing from the scope of the present disclosure, the proximal end of the breathing tube could traverse the lower part of the visor which is facing the lower chamber 52.

As is evident in FIG. 1, the breathing tube 20 extends from its proximal end by following one of the side edges of the frame 12 as far as an upper portion 14 of the frame, to then extend in a direction opposite that of the lower chamber 52.

The distal end 20*b* of the breathing tube 20 is fitted with orifices to allow the entry of air in the breathing tube. The breathing tube 20 includes at least one channel 21 which is fluidically connected with the lower chamber 52 and with the orifices 23 of the distal end 20*b* of the breathing tube 20. In this example, the breathing tube is a snorkel.

According to the disclosure, the diving mask 10 further includes a telecommunications device 500 which is mounted to the breathing tube 20. The telecommunications device 500 includes a first part 502 which is arranged at the proximal end 20*a* of the breathing tube 20. In this example, the first part 502 includes a microphone 504 which leads in the channel 21. Without departing from the scope of the present disclosure, the microphone could also terminate in the lower chamber 52.

The second part 506 of the telecommunications device is arranged at the distal end 20*b* of the breathing tube 20. In this example, the second part 506 includes an antenna 517.

The telecommunications device 500 further includes a third part 510, mounted to the frame, which comprises a control button 512 for controlling the telecommunications device. The third part 510 further includes a control element integrated into the frame 12.

Pour the restitution of the sound, the third part of the telecommunications device further includes a loudspeaker 514 which is integrated into the frame.

Without departing from the scope of the present disclosure, the loudspeaker can be arranged at another point, and for example be shifted from the frame while being connected by a linking arm.

In the example of FIG. 1, it is evident that the breathing tube 20 forms one and the same piece with the frame 12, and the electrical linking members, especially the wires, which connect the first, second and third parts of the telecommunications device are integrated into the mask without however being shown in the drawing of FIG. 1.

Figure 2A:
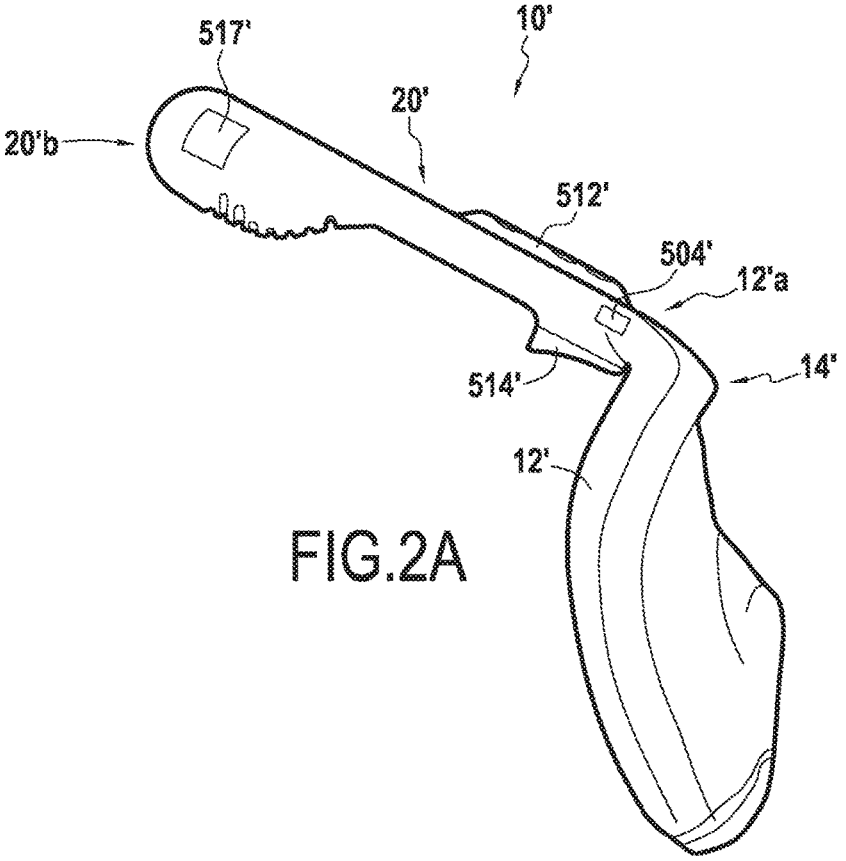
FIGS. 2A and 2B illustrate a variant of the mask of FIG. 1, the snorkel extending from the upper part of the frame.
Figure 2B:
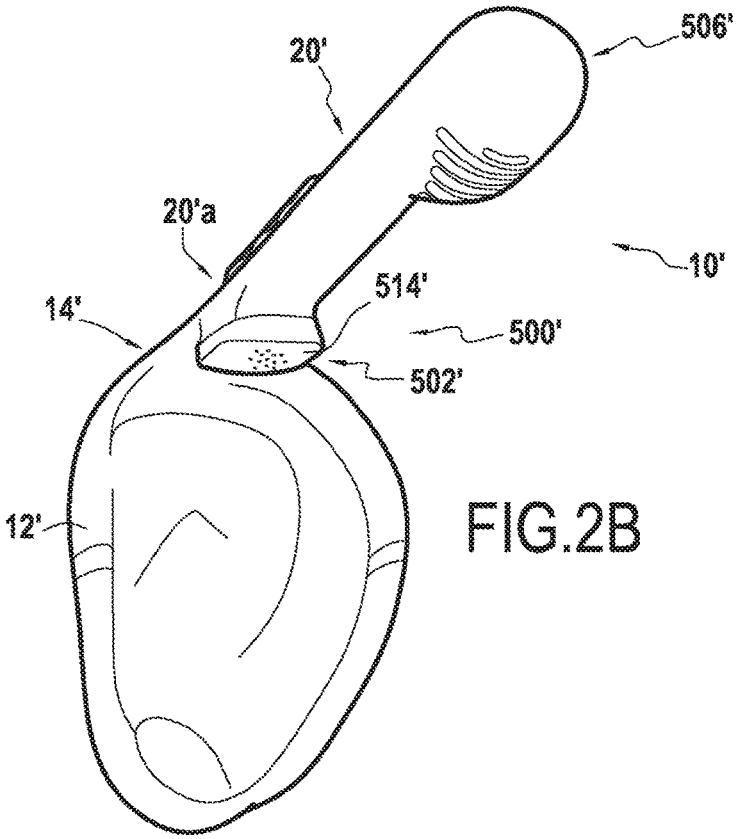

FIGS. 2A and 2B illustrate a diving mask 10' which is a variant of the diving mask 10 according to the first embodiment. The diving mask 10' differs from that of FIG. 1 by the fact that the breathing tube 20' is connected to an upper part 12*a'* of the frame 12' of the diving mask 10'.

Here too, the breathing tube 20' forms one and the same piece with the frame 12'. The diving mask 10' also comprises a telecommunications device 500' which includes a first part 502' arranged at the proximal end 20*a'* of the breathing tube 20'. In this example, the first part 502' includes a microphone 504', and control buttons 512' are arranged on an upper face of the breathing tube 20', as is clear in FIG. 2A.

The first part 502' further includes a loudspeaker 514' which is arranged on a lower face of the breathing tube 20', partially proximal.

The telecommunications device 500' further includes a second part 506' arranged at the distal end 20*b'* of the breathing tube 20' which includes an antenna 517'.

Figure 3:
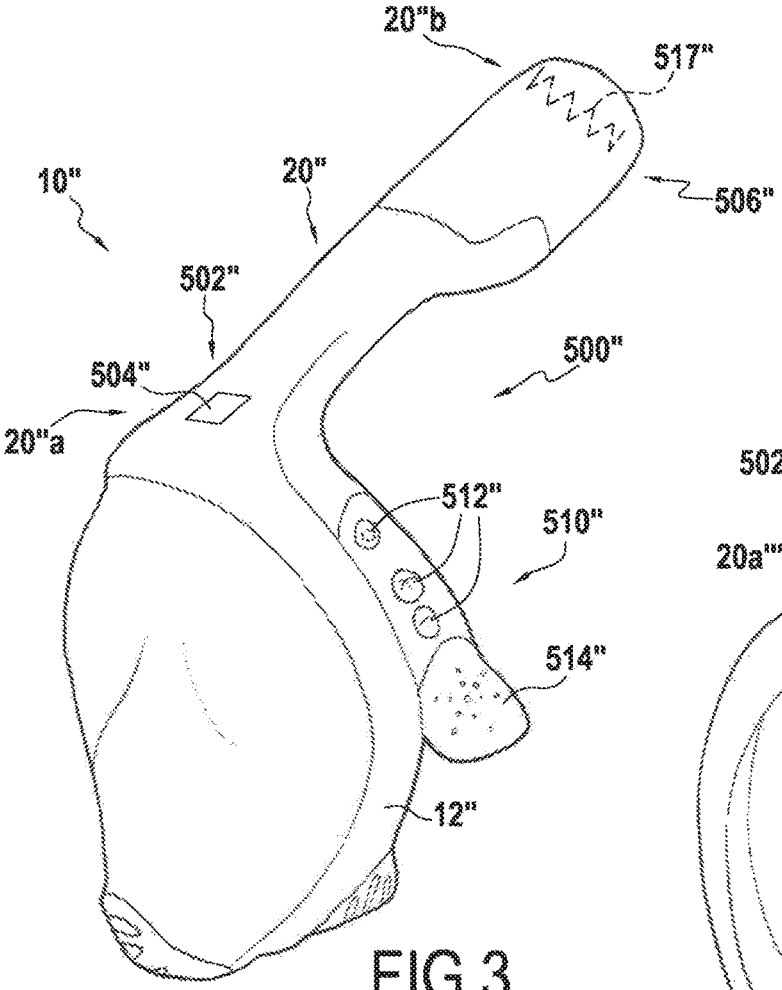
FIG. 3 illustrates a variant of the mask of FIG. 2A, wherein the loudspeaker and control buttons are shifted on a side edge of the mask.

FIG. 3 illustrates a variant 10" of the diving mask according to the first embodiment. The mask 10" illustrated in FIG. 3 differs from the mask 10' of FIGS. 2A and 2B by the fact that the loudspeaker 514" and the control buttons 512" are mounted to the frame 12". The first part 502" as such includes the microphone 504" while the distal end 20*b"* of the breathing tube 20" includes the second part 506" of the telecommunications device which includes the antenna 517".

Figure 4A:
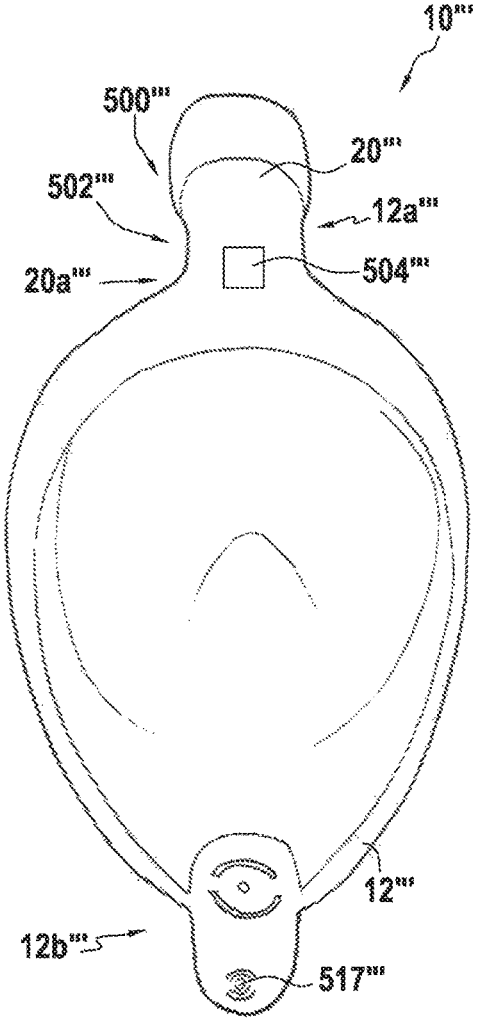
FIGS. 4A and 4B illustrate a variant of the first embodiment wherein the mask includes an ultrasound antenna arranged in the lower part of the frame.
Figure 4B:
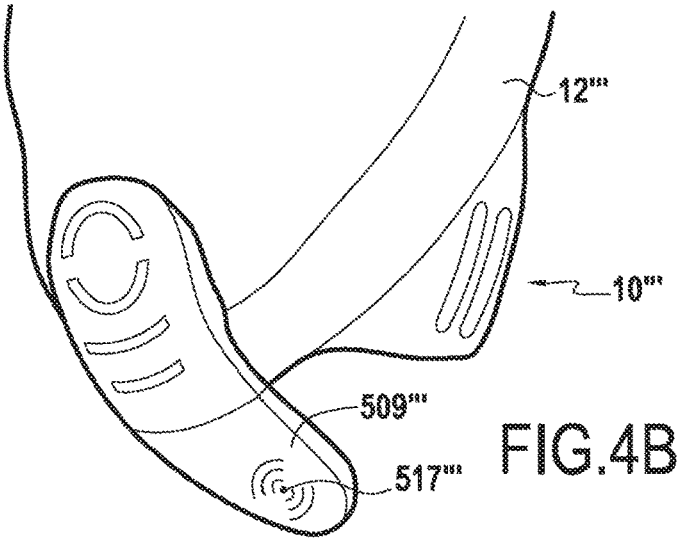

FIGS. 4A and 4B illustrate a diving mask 10''' according to a variant of the first embodiment of the disclosure. In this variant the diving mask 10''' also includes a breathing tube 20''' having a proximal end 20*a'''* to which is arranged the first part 502''' of the telecommunications device 500', the first part 502" of the telecommunications device includes a microphone 504". The variant of FIGS. 4A and 4B essentially differs from that of FIG. 3 by the fact that the antenna 517''' is not arranged at the distal end of the breathing tube but in the lower part of the frame 12". In the variant of FIGS. 4A and 4B, the antenna 517" is an ultrasound antenna configured to transmit and receive ultrasound. The antenna 517''' is also connected to an electronic device arranged into the mask which is adapted to transform the signal emanating from the microphone 504''' into an ultrasound signal. The electronic device may be adapted to transform an ultrasound signal received by the antenna 517" into an audio signal which is then transmitted to the loudspeaker of the diving mask.

In this example, the ultrasound antenna 517''' is arranged in a case 509''' which projects downwards from the lower end of the frame 12".

By way of FIGS. 5 to 7 a diving mask 110 according to a second embodiment of the disclosure and the detachable breathing tube according to the disclosure will now be described.

Figure 5:
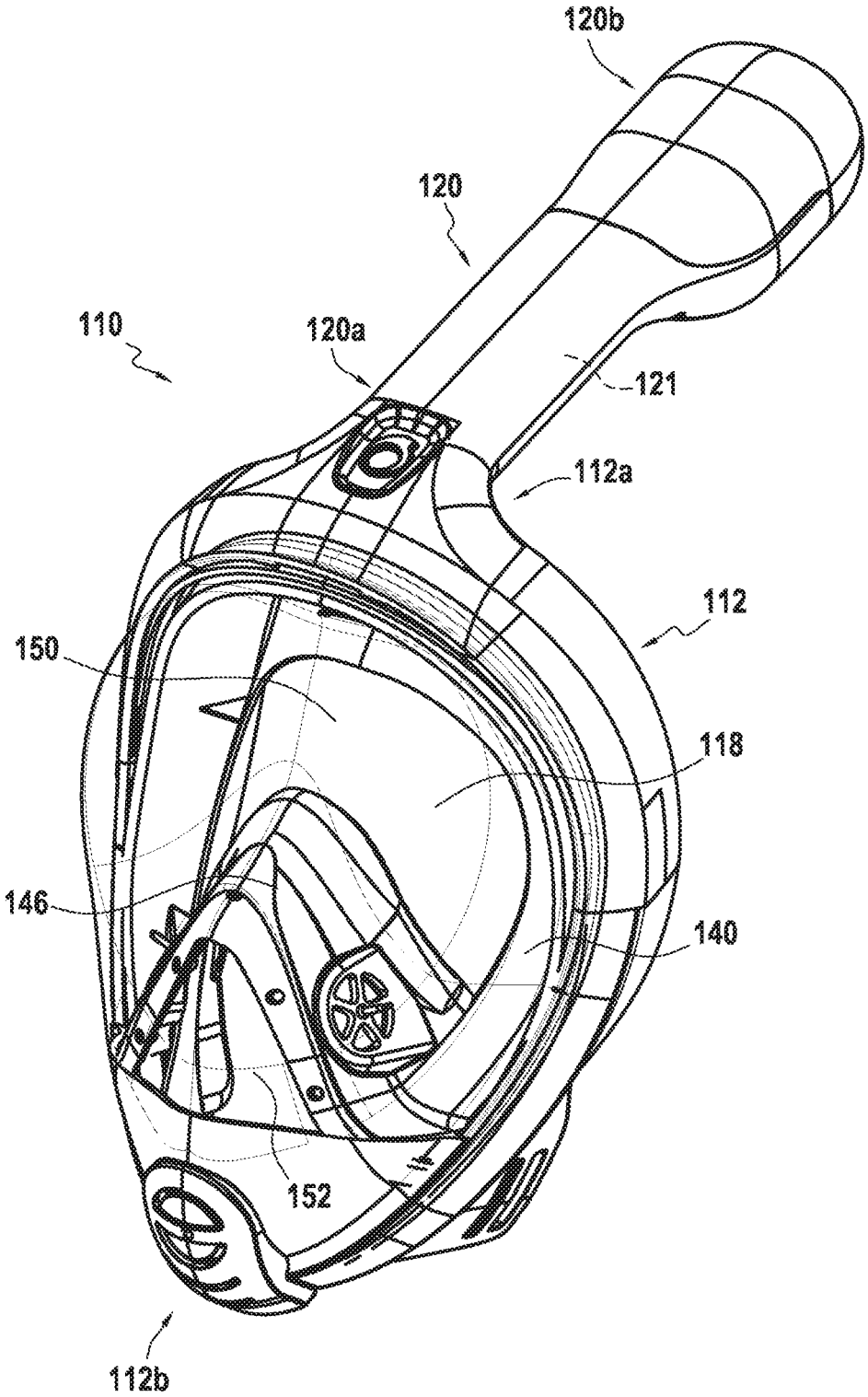
FIG. 5 illustrates a diving mask according to a second embodiment of the disclosure.

The diving mask 110 illustrated in FIG. 5 includes a frame 112 fitted with a visor 118, a flexible skirt 140 fixed to the frame, the flexible skirt including a partition 146 delimiting an upper chamber 150 for viewing from a lower chamber 152 for breathing, the partition being arranged to bear upon the nose of the user such that the mouth and the nose of the user are in the lower chamber, while the eyes of the user are in the upper chamber.

The diving mask 110 also includes a breathing tube 120 which includes a proximal end 120*a* for linking the breathing tube to the frame at a distal end 120*b* opposite the proximal end.

Figure 6A:
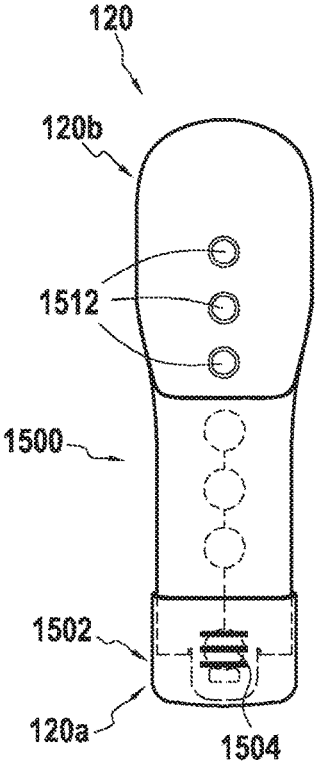
FIGS. 6A to 6C illustrate a breathing tube according to the disclosure integrating a telecommunications device for the diving mask of FIG. 5.

The breathing tube 120 includes at least one channel 121, illustrated in FIG. 6A and fluidically connected with the lower chamber 152. In the example of FIG. 5, the breathing tube 120 extends from the upper part 112*a* of the frame 112. However, without departing from the scope of the present disclosure, the breathing tube could extend from the lower part 112*b* of the frame 112. In this example, the breathing tube 120 is a snorkel whereof the distal end 120*b* includes openings 123 for enabling exchange of air with the atmosphere.

In the second embodiment, the breathing tube 120 is detachable from the frame 112. Furthermore, the telecommunications device 1500 is arranged in the breathing tube 120.

By way of FIGS. 6A to 6C, a first example of the detachable tube 120 for the diving mask according to the second embodiment will be described.

Figure 6B:
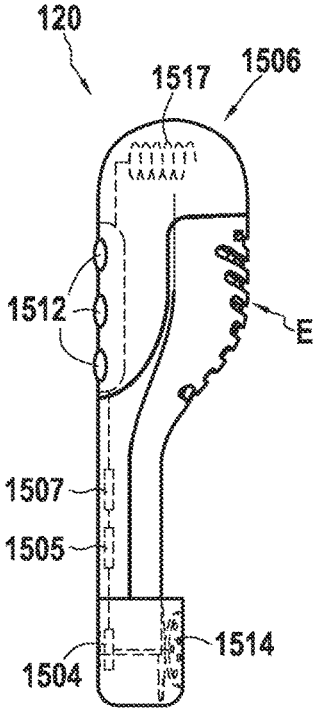
Figure 6C:
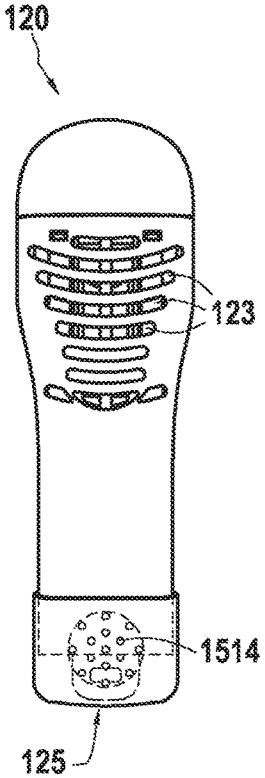

FIGS. 6A to 6C illustrate an embodiment of the detachable breathing tube 120 according to the disclosure. This detachable breathing tube has a proximal end 120*a* for linking the breathing tube 120 to the frame 112 of the diving mask of FIG. 5 and a distal end 120*b* opposite the proximal end. The distal end 120*b* comprises the air inlet E which consists of orifices 123.

The diving mask 110 further includes a telecommunications device 1500 which is mounted to the breathing tube 120. More precisely, in this second embodiment the telecommunications device 1500 is integrated into the detachable breathing tube 120. The telecommunications device 1500 includes a first part 1502 arranged at the proximal end 120*a* of the breathing tube 120, the first part 1502 including a microphone 1504 and a loudspeaker 1514. In this example, the microphone 1504 terminates in the channel 121, while the loudspeaker 1514 is arranged so as to direct sounds towards the head of the user when the breathing tube is fixed to the diving mask. In this example, the loudspeaker is directed towards the same side of the breathing tube as that of the air inlet.

The telecommunications device 1500 further includes a second part 1506 arranged at the distal end 120*b* of the breathing tube 120. This second part 1506 includes an antenna 1517. Control buttons 1512 are also provided on the body of the breathing tube 120. The detachable breathing tube 120 further includes an electronic device including a transmitter module and/or a receiver module connected to the antenna 1517, the microphone 1504 and the loudspeaker 1514.

The telecommunications device 1500 further includes receiver/transmitter modules 1505 and 1507 which are arranged in this example in the body of the breathing tube 120.

For its detachable fastening to the frame 112 of the diving mask 110, the breathing tube includes at its proximal end a coupling member 125.

Figure 7:
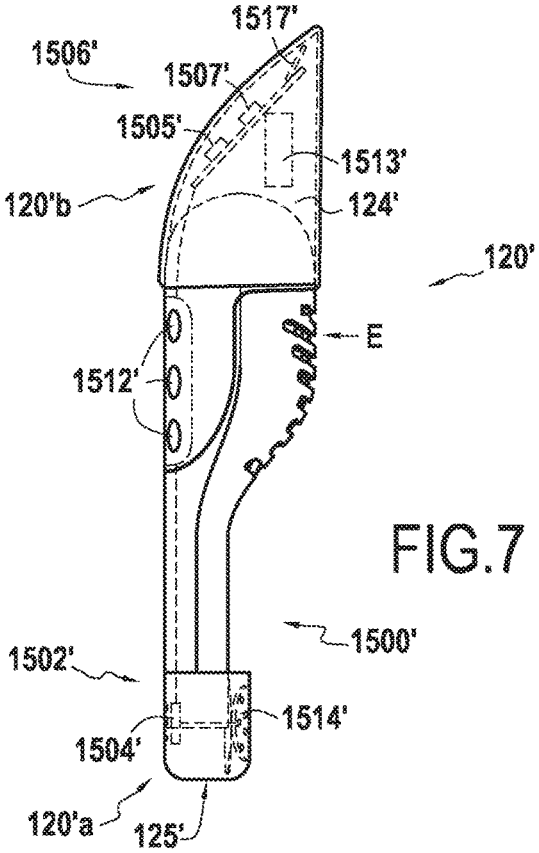
FIG. 7 is a variant of the detachable breathing tube of FIG. 6B.

FIG. 7 illustrates a detachable breathing tube 120' wherein is arranged a telecommunications device 1500', this breathing tube 120' being designed to be coupled to the diving mask 110 illustrated in FIG. 5. The breathing tube 120' also has a proximal end 120'*a* and a distal end 120'*b*. The telecommunications device also includes a first part 1502' which includes a loudspeaker 1514' and a microphone 1504'. Control buttons 1512' are also arranged on the body of the breathing tube. Like that of FIGS. 6A to 6C, the detachable breathing tube 120' further includes a coupling member 125' for its fastening to the frame of the mask.

The breathing tube 120' of FIG. 7 differs from that of FIGS. 6A to 6C by the fact that the second part 1506' of the telecommunications device includes not only the antenna 1517', but also the battery 1513' and the transmitter/receiver modules 1505' and 1507', these elements being arranged beyond the air inlet E of the breathing tube. To do this, the breathing tube 120' includes a cap 124' which has an extension forming a housing to sealingly receive the above electronic components of the telecommunications device 1500'.

By way of FIGS. 8 to 25B, a third embodiment of the diving mask 210 of the disclosure, as well as the detachable connector according to the disclosure will now be described.

Figure 8:
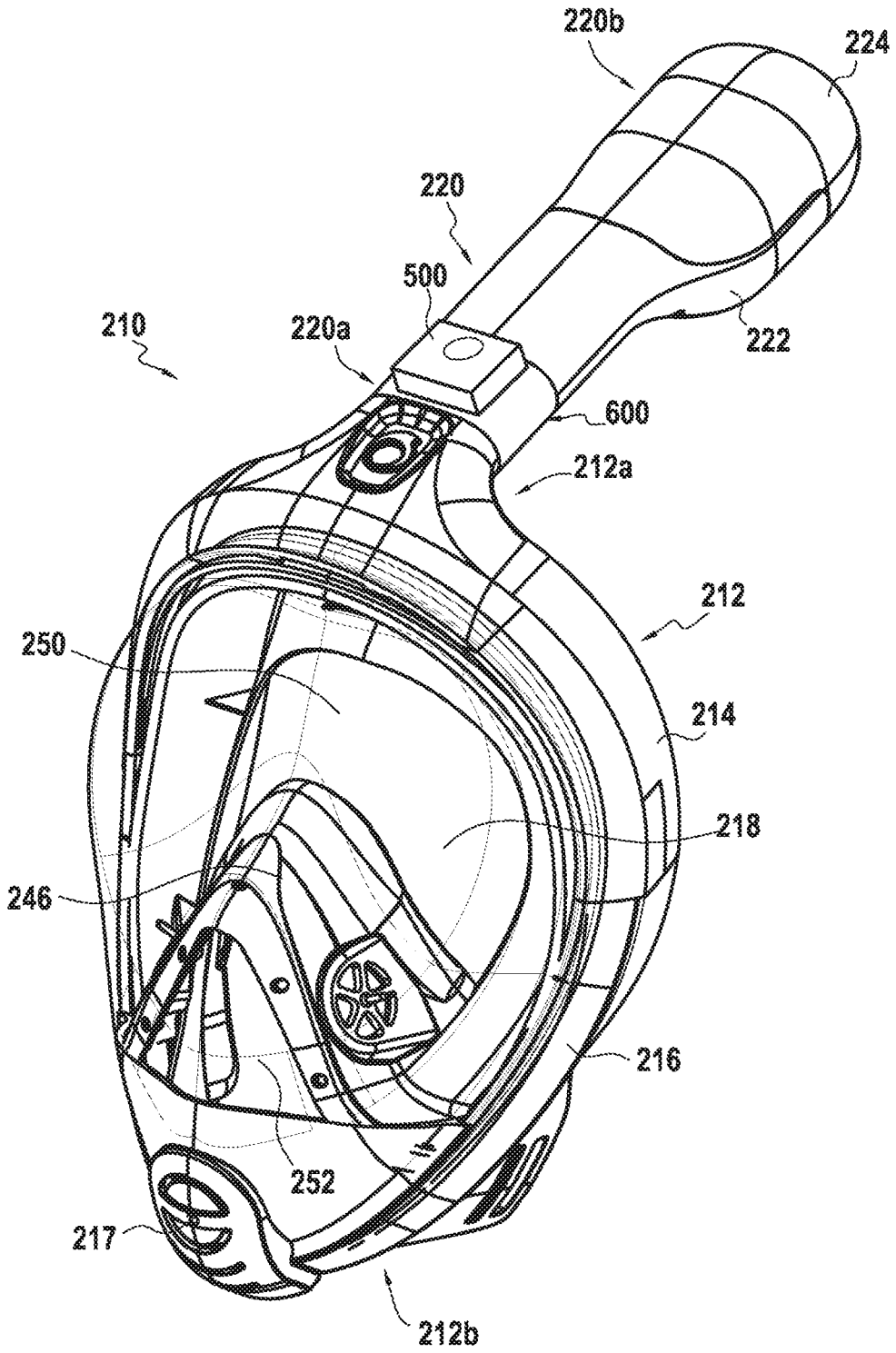
FIG. 8 is a perspective view of a diving mask according to the third embodiment the disclosure.

The diving mask 210 illustrated in FIG. 8 includes a frame 212 of general oblong shape having an upper part 212*a* and a lower part 212*b*. The frame 212 is fitted with a visor 218.

In this example, the frame 212 includes an upper portion 214 forming an upper strapping and a lower portion 216 constituting a lower strapping.

The upper 214 and lower 216 portions of the frame are fixed to each other to form a strapping enclosing the face of the user.

As is evident from FIG. 8, the frame 212 encloses the visor 218. This mask further includes a purge valve 217 for evacuation of water which would have been able to enter the mask.

The diving mask 210 also includes a breathing tube 220 which has a proximal end 220*a*, in this case its lower end, which includes a fastening member 229 adapted to be connected to the upper part 212*a* of the frame.

In this example, the breathing tube 220 is detachable. It can be detached or unclipped from the frame 212, reducing the bulk of the mask when the latter is not being used.

Figure 9:
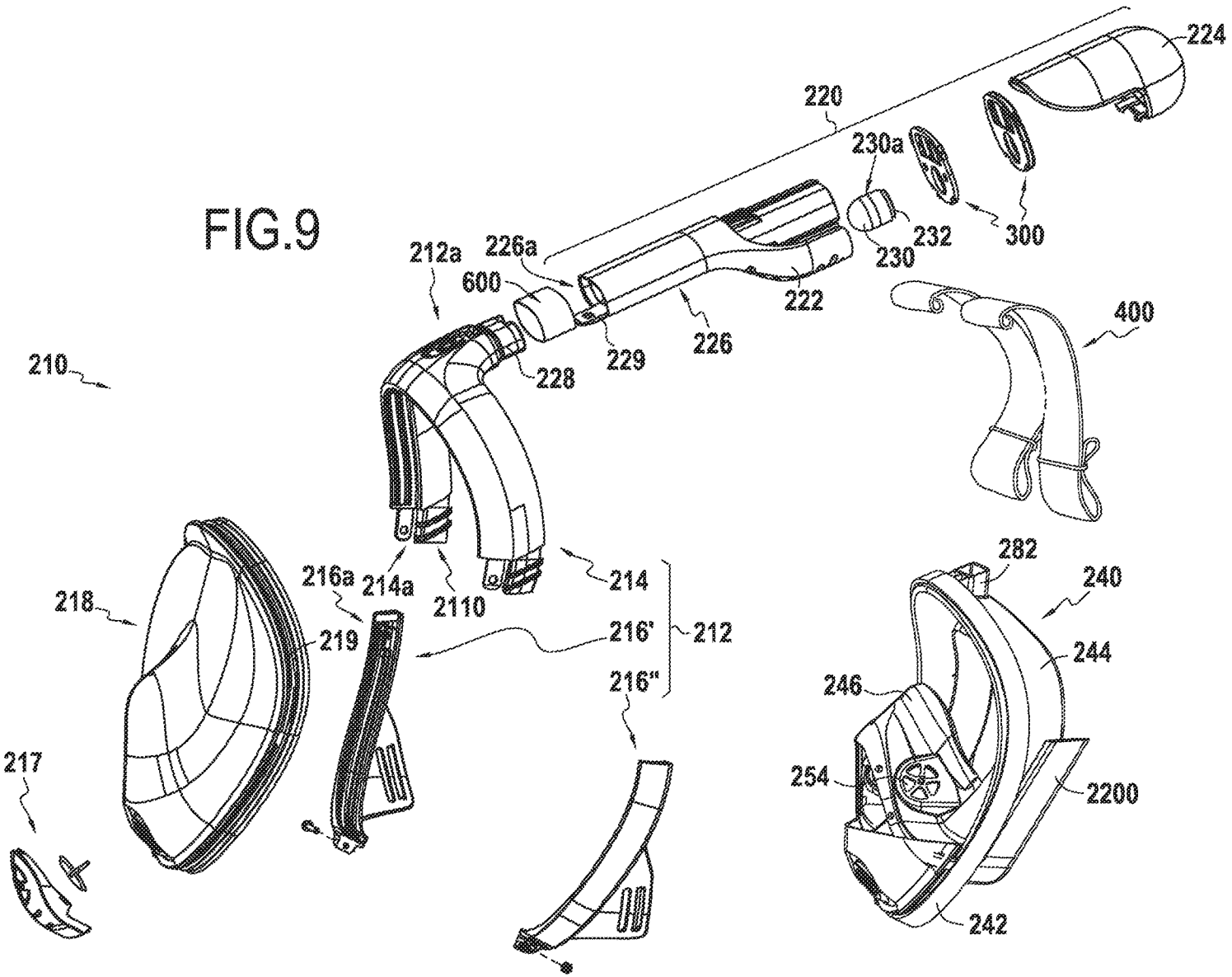
FIG. 9 is an exploded view of the diving mask of FIG. 8.

The breathing tube 220, seen more clearly in FIG. 9, also has a distal end 220*b* which is fitted with a cage 222 permeable to air.

As will be described in more detail hereinbelow, the breathing tube 220 further includes a cap 224 which cooperates with the cage 222.

In reference now to the exploded view of FIG. 9, it is clear that the lower portion 216 of the frame 212 includes a first element 216' and a second element 216" which are fixed to each other to form the lower portion. Without departing from the scope of the present disclosure, the frame could be constituted by one and the same piece.

It is also evident that the breathing tube 220 includes a slender body 226 whereof the lower end 226*a* is capable of nesting with an extension 228 of the upper portion 214 of the frame 212 which projects from the upper end 212*a* of the frame.

Also, the breathing tube 220 includes a float 230 which is movable in the cage 222, the float including an upper end 230*a* fitted with a blocking device 232. As will be explained in more detail hereinbelow, the float 230 is arranged such that when the breathing tube 220 is immersed in water the float shifts so that the blocking device 232, in this case a flexible membrane, closes off the entry of the breathing tube.

Figure 10:
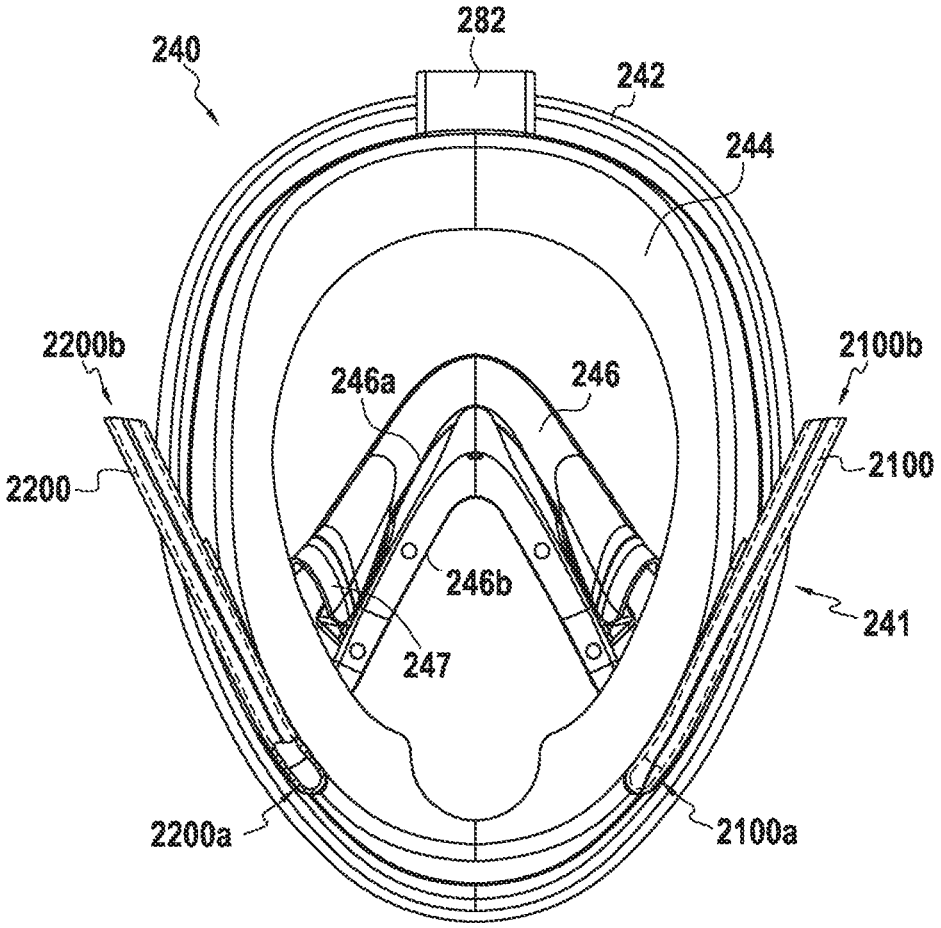
FIG. 10 is a rear view of the flexible skirt of the mask of FIG. 8.
Figure 11:
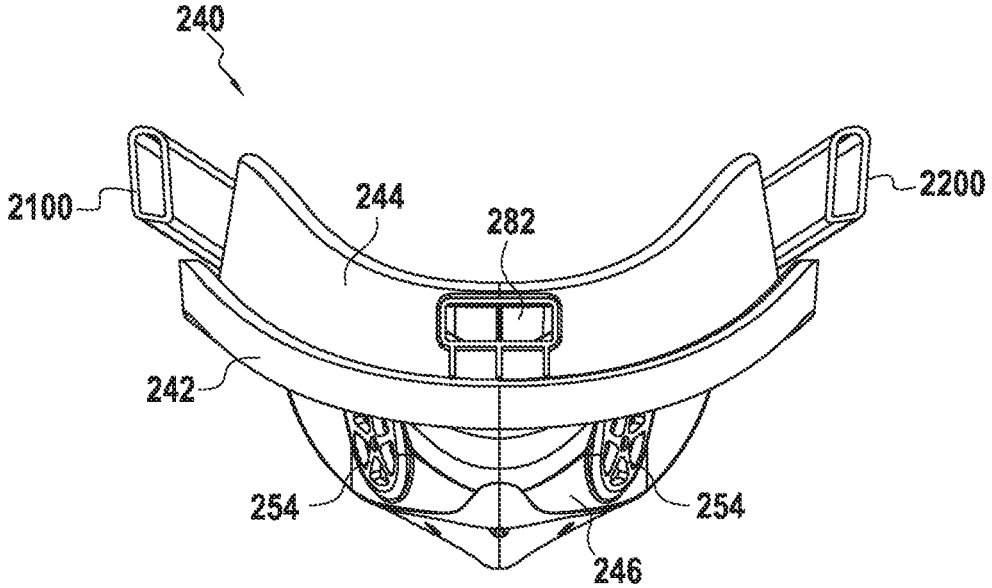
FIG. 11 is a plan view of the flexible skirt of FIG. 10.
Figure 12:
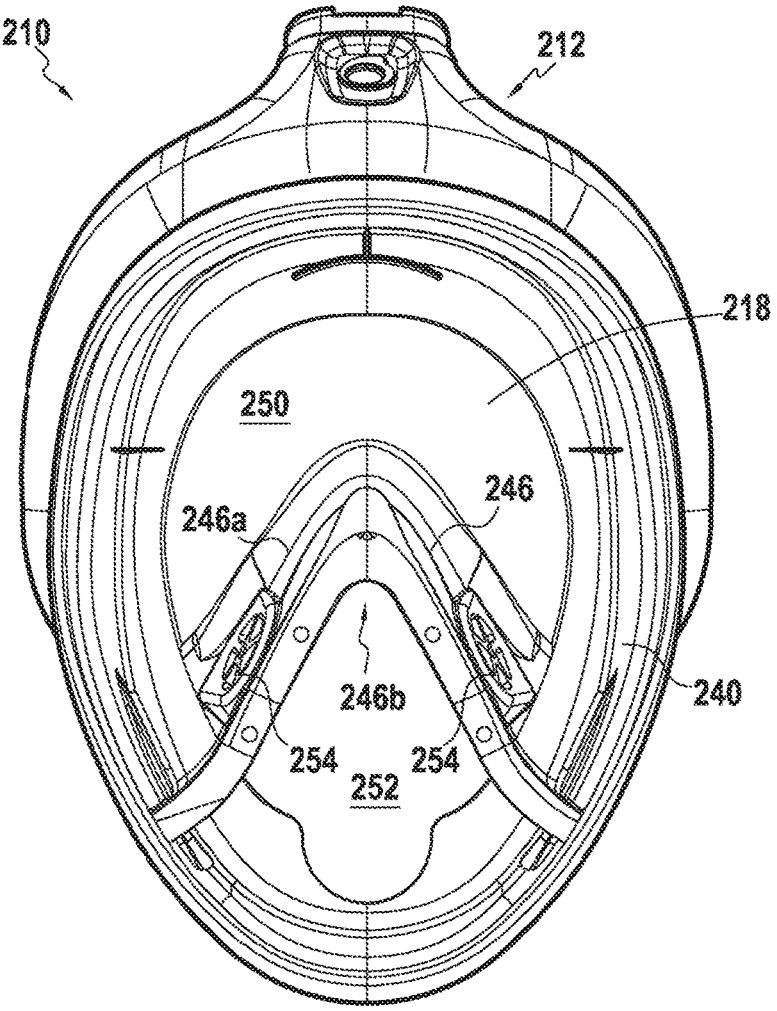
FIG. 12 is a frontal view of the flexible skirt of FIG. 11 assembled with the frame.

In reference to FIGS. 10, 11 and 12, it is evident that the flexible skirt 240 has a general oblong shape substantially of the same dimension as the frame 212 and the visor 218.

The flexible skirt includes a circumference 242 which has an upper part fixed to the lower portion of the frame.

The flexible skirt 240 further includes a peripheral sealing lip 244 arranged to bear against the face of the user so as to prevent water from seeping in between the face of the user and the visor.

The flexible skirt 240 further includes a partition 246 which is arranged to bear upon the nose of the user. This partition 246 delimits an upper chamber 250 for viewing from a lower chamber 252 for breathing. As is clear from FIG. 12, which illustrates the frame 212 assembled with the visor 218 and the skirt 240, the mouth and the nose of the user are in the lower chamber 252, while the eyes of the user are in the upper chamber 250.

Otherwise expressed, the upper chamber 250 is delimited by the visor, the eyes of the user, the upper wall 246*a* of the partition 246, and the part of the flexible skirt which extends above the partition 246.

Also, the lower chamber 252 is delimited by the visor 218, the mouth and the nose of the user, the lower part 246*b* of the partition 246, and by the part of the flexible skirt which extends below the partition 246.

In this example, the partition includes a pair of passageways 254 fitted with check valves arranged to enable circulation of inspired air directed only from the upper chamber 250 towards the lower chamber 252 during an inspiration phase of the user. In this example, the flexible skirt is made of silicone and forms one and the same piece with the partition 246, the sealing lip 244 and the circumference 242.

Figure 13:
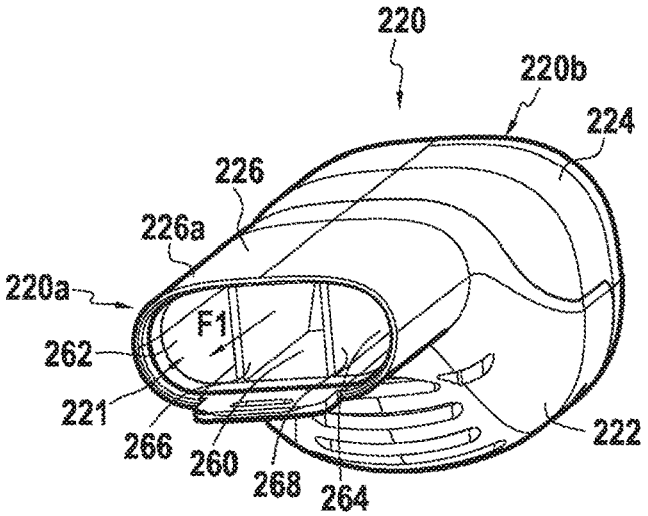
FIG. 13 illustrates the breathing tube of the mask of FIG. 8, viewed from its lower end.

FIG. 13 illustrates the breathing tube 220, seen from its proximal end 220*a*.

It is evident that the breathing tube 220 comprises an inspired air intake channel 260 which extends between the proximal end 220*a* of the breathing tube and the distal end 220*b* of the breathing tube. This inspired air intake channel extends according to the longitudinal direction of the body 226. As will be explained in more detail hereinbelow, the inspired air intake channel terminates in the upper chamber.

The breathing tube 220 further includes two channels 221 fluidically connected with the lower chamber, i.e. a first expired air exhaust channel 262, which also extends according to the longitudinal direction of the body 226 between the proximal end 220*a* and the distal end 220*b* of the breathing tube 220. This first expired air exhaust channel 262 communicates with the lower chamber 252.

In this example, the breathing tube 220 includes a second expired air exhaust channel 264 similar to the first expired air intake channel.

As is clear from FIG. 13 the inspired air intake channel 260 is separated from the first and second air exhaust channels 262, 264 by two longitudinal walls 266, 268.

Figure 14:
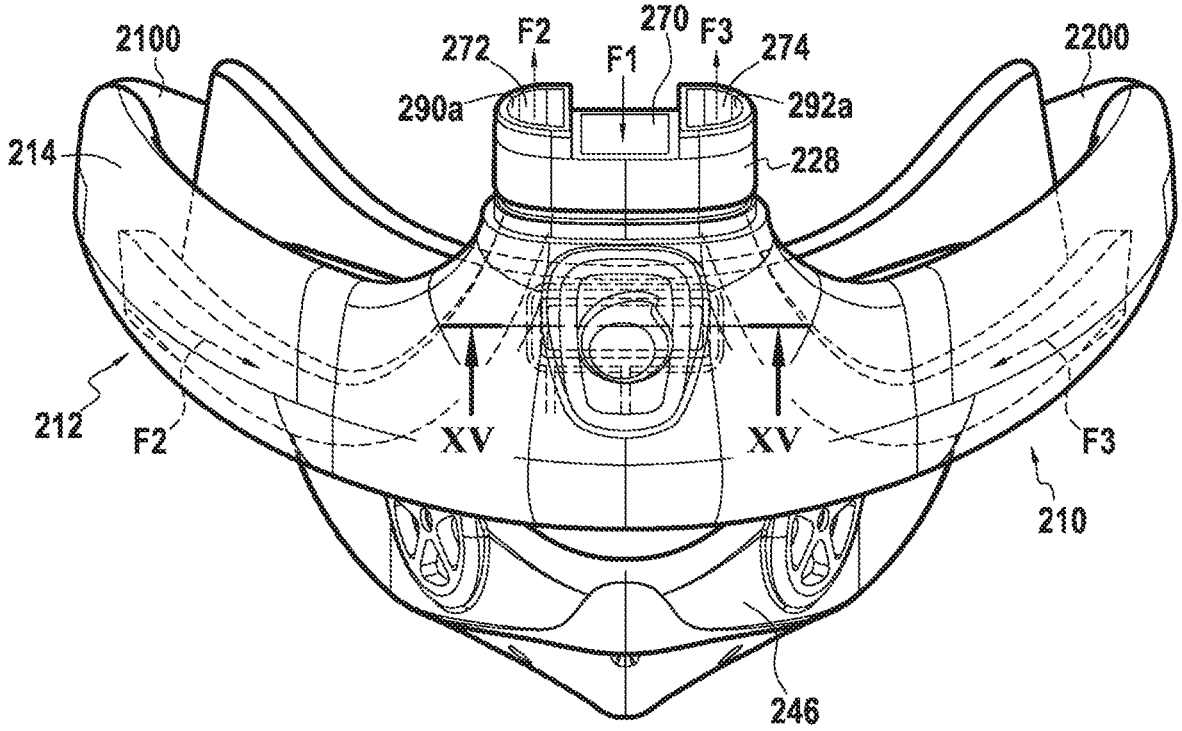
FIG. 14 is a plan view of the flexible skirt assembled with the frame.

As is clear from FIG. 14, which shows the frame 212 assembled on the flexible skirt 240 in plan view, the extension 228 further includes a central channel 270 arranged to communicate with the inspired air intake channel 260 when the breathing tube is fixed to the frame, and two expiration channels 272, 274 arranged to respectively communicate with the first and second expired air exhaust channels 262, 264.

Figure 15:
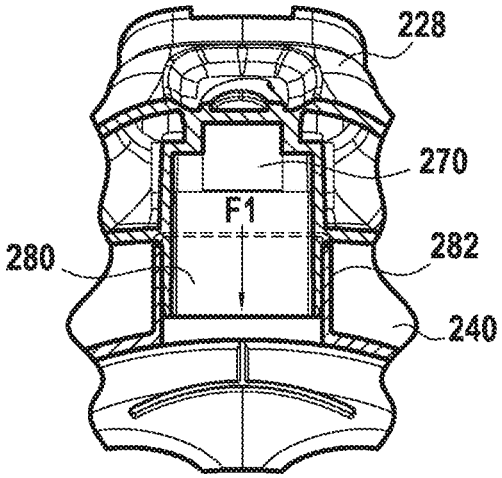
FIG. 15 is a detailed view of the connection of the top sleeve of the flexible skirt of FIG. 11 with the top connector of the frame.

In reference now to FIG. 15, it is evident that the frame 212 further includes a top connector 280 which projects from the upper portion 214 of the frame 212. The flexible skirt 240 as such includes a top sleeve 282 which projects from an upper part of the flexible skirt 240 and terminates in the upper chamber 250. It is clear that the top connector 280 engages inside the top sleeve 282 to create a sealed connection between these two elements. In FIG. 15, the arrow F1 symbolises the flow of fresh inspired air.

It is understood that during an inspiration phase, fresh air enters into the breathing tube, flows into the inspired air intake channel, then into the upper chamber 250 by passing through the top sleeve 282.

The circuit of expired air will now be described.

Arranged in the frame 212, and more particularly in the upper part 214 of said frame is a first inner duct 290 for expired air, and a second inner duct 292 for expired air. However, without departing from the scope of the present disclosure the first and second inner ducts 290, 292 can be arranged in a peripheral circumference 219 of the visor 218 which borders the inner circumference of the frame 212. According to another variant, the mask can include a single inner duct for expired air. Similarly, the breathing tube can also include a single inspired air intake channel.

Figure 16:
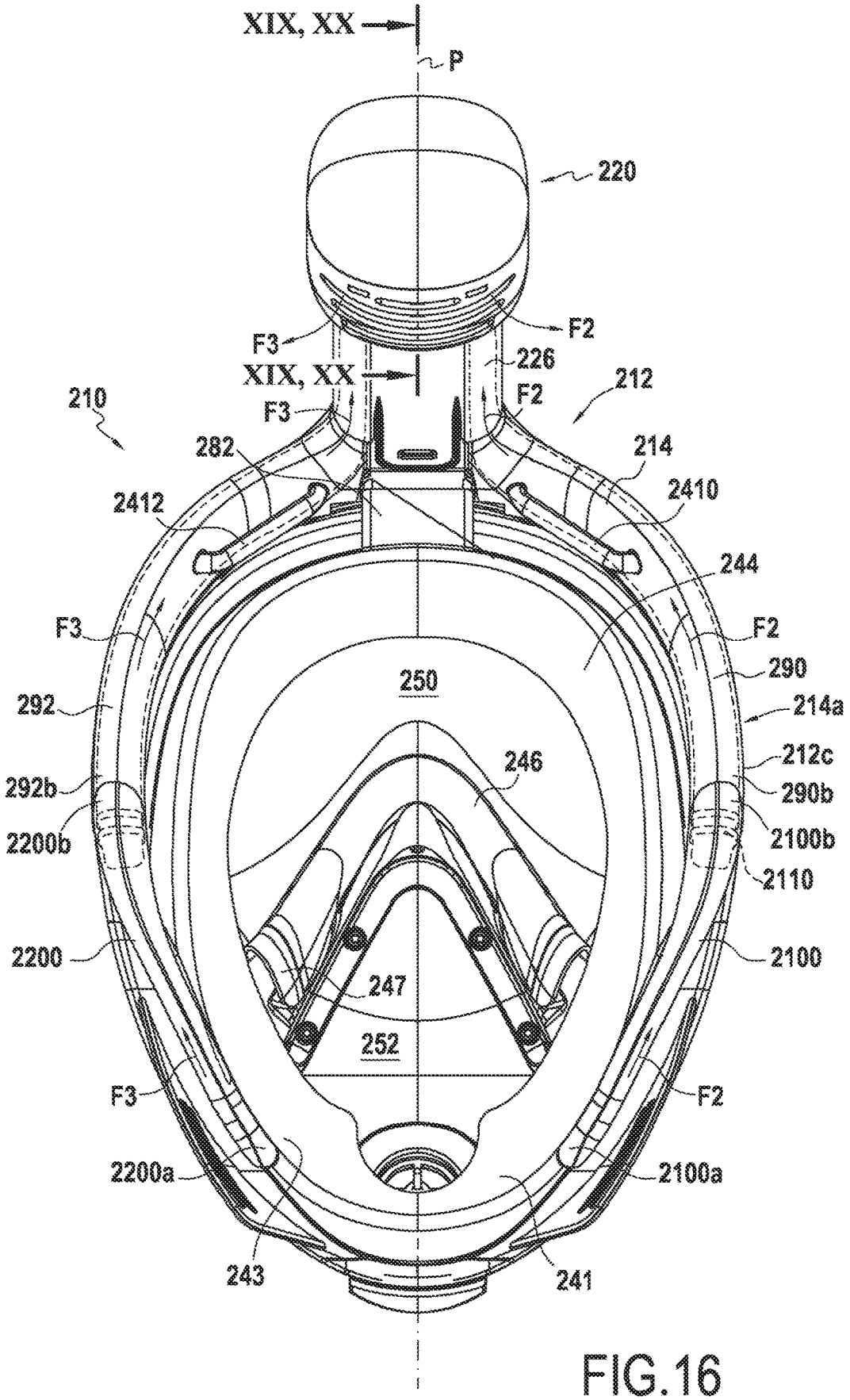
FIG. 16 is a rear view of the mask of FIG. 8, without the fastening strap.

As is clear from FIG. 16, these first and second inner ducts are arranged on either side of a longitudinal plane P of the mask. This plan P here constitutes the plane of symmetry of the mask.

To the extent where the first and second inner ducts 290, 292 are identical, only the first inner duct 290 will be described. The latter has an upper end which corresponds to the outlet of the channel 272 illustrated in FIG. 14. The first inner duct 290 further has a lower end.

Also, the flexible skirt 240 further includes a first sleeve 2100 projecting from a first side edge 241 of the flexible skirt 240 and extending towards the upper part 212*a* of the frame 212. The first sleeve, which forms one and the same piece with the flexible skirt, has a lower end 2100*a* leading in the lower chamber 252 and an upper end 2100*b* opposite the lower end, which is fluidically connected with the lower end of the first inner duct. It is understood that the sleeve forms a duct for expired air.

The flexible skirt further includes a second sleeve 2200, identical to the first sleeve 2100, whereby the second sleeve 2200 projects from a second side edge 243 of the skirt 240, opposite the first side edge 241. The second sleeve has a lower end 2200*a* leading in the lower chamber 252 and an upper end 2200*b* opposite the lower end which is fluidically connected with the lower end 292*b* of the second inner duct 292.

In reference to FIG. 16, it is evident that the first inner duct 290 extends between the apex of the frame and a lower end 214*a* of the upper portion 214 of the frame.

Figure 17A:
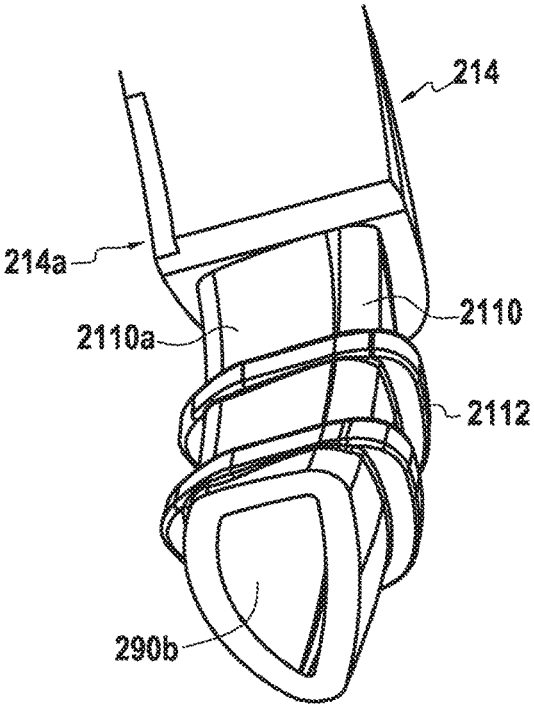
FIGS. 17A and 17B are detailed views of the connection of the first sleeve of the flexible skirt with the first lateral connector of the frame.
Figure 17B:
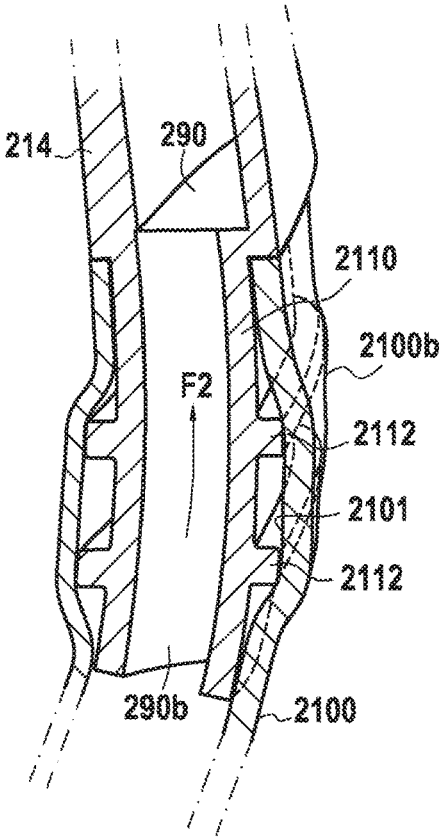

In reference to FIGS. 16, 17A and 10B, it is evident that the frame 212, and more precisely the lower end of the upper portion 214 of the frame 212 includes a first lateral connector 2110 which is engaged in the second end 2100*b* of the first sleeve. To improve strength and sealing, the first lateral connector 2110 includes grooves 2112 on its external face 2110*a*, the grooves 2112 cooperating with the internal face 2101 of the second end of the first sleeve. In reference again to FIG. 16, it is evident that the second end of the first sleeve brushes a lateral side 212*c* of the frame 212.

It is understood therefore that expired air flows successively through the first sleeve 2100, through the first inner duct 290 then through the first expired air exhaust channel 262. This outgoing airflow is illustrated by arrow F2. Arrow F3 as such illustrates the other outgoing air circuit which flows via the second sleeve 2200 and the second inner duct 292.

By way of FIGS. 18 to 20 more particularly the upper portion of the breathing tube 220 will now be described.

The breathing tube 220 of the mask according to the disclosure includes at its upper end means for adjusting the air inlets and outlets in the breathing tube. For this purpose the breathing tube 220 includes a wafer 2300 which is sealingly arranged between the cap 224 and the upper end 226*b* of the body 226 of the breathing tube 220.

This wafer includes a main orifice 2302 communicating with the intake E of the breathing tube. In this example, the intake E of the breathing tube is made by slots 223 made in the cage 222.

The wafer 2300 further includes an inlet orifice 2304 communicating with the intake 260*a* of the inspired air emission channel 260.

The wafer 2300 further includes a first outlet orifice 2306 which communicates with the outlet 262*a* of the first exhaust channel 262.

The wafer 2300 further includes a second outlet orifice 2308 which communicates with the outlet 264*a* of the second expired air exhaust channel.

Figure 18:
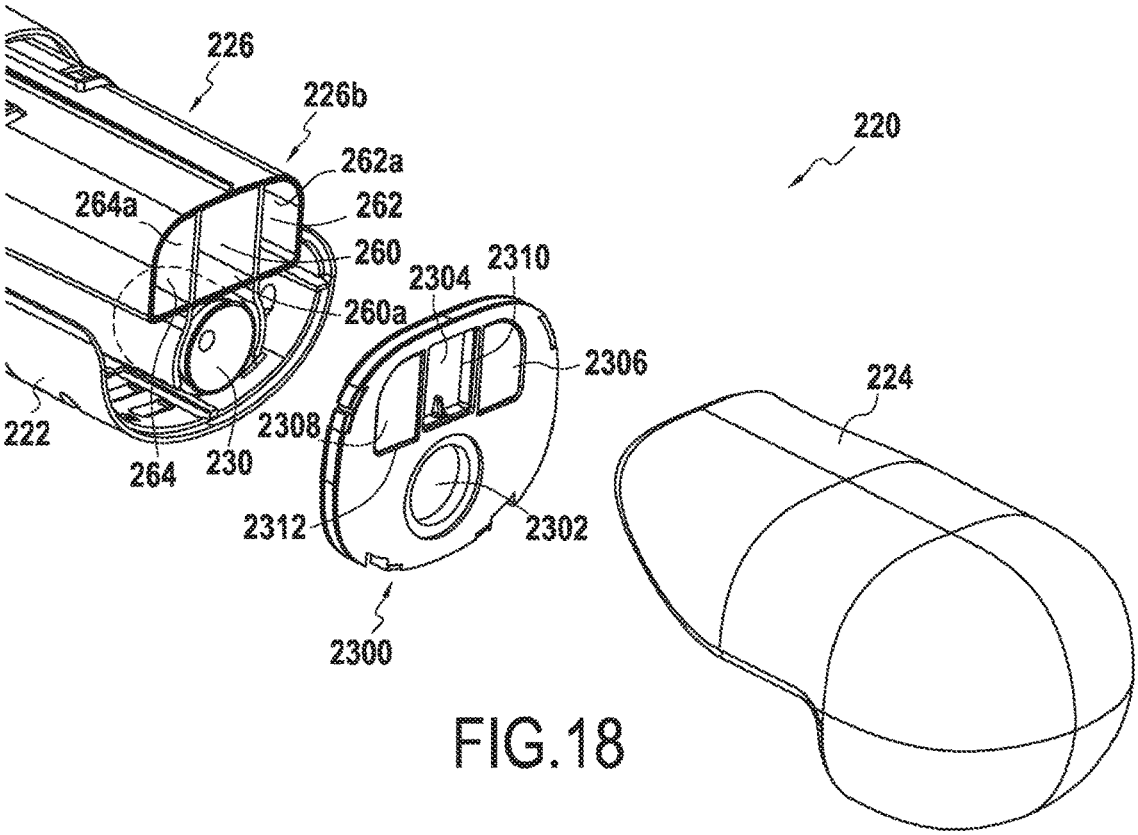
FIG. 18 is an exploded view of the upper part of the breathing tube of the mask of FIG. 8.

As is seen from FIG. 18, the sections of the main orifice 2302, of the inlet orifice 2304 and the two outlet orifices 2306, 2308 substantially correspond to the transversal sections of the inspired air intake channel 260 and the expired air exhaust channels 262, 264.

The wafer 2300 further includes a first check valve 2310 arranged facing the first inlet orifice 2304 to block said inlet orifice during an expiration phase. The wafer 2300 further includes a second check valve 2312, arranged facing the first outlet orifice to block said first outlet orifice during an inspiration phase. And, in this example the wafer 2300 also includes a third check valve 2312 which is arranged to block the second outlet orifice during an inspiration phase.

The breathing tube 220 further includes a fluid communication chamber 2350 wherein the main orifice 2302, the inlet orifice 2304, the first outlet orifice 2306 and the second outlet orifice 2308 terminate. The fluid communication chamber 2350 is arranged in the cap 224 which is sealingly fixed to the upper end of the body 226.

Figure 19:
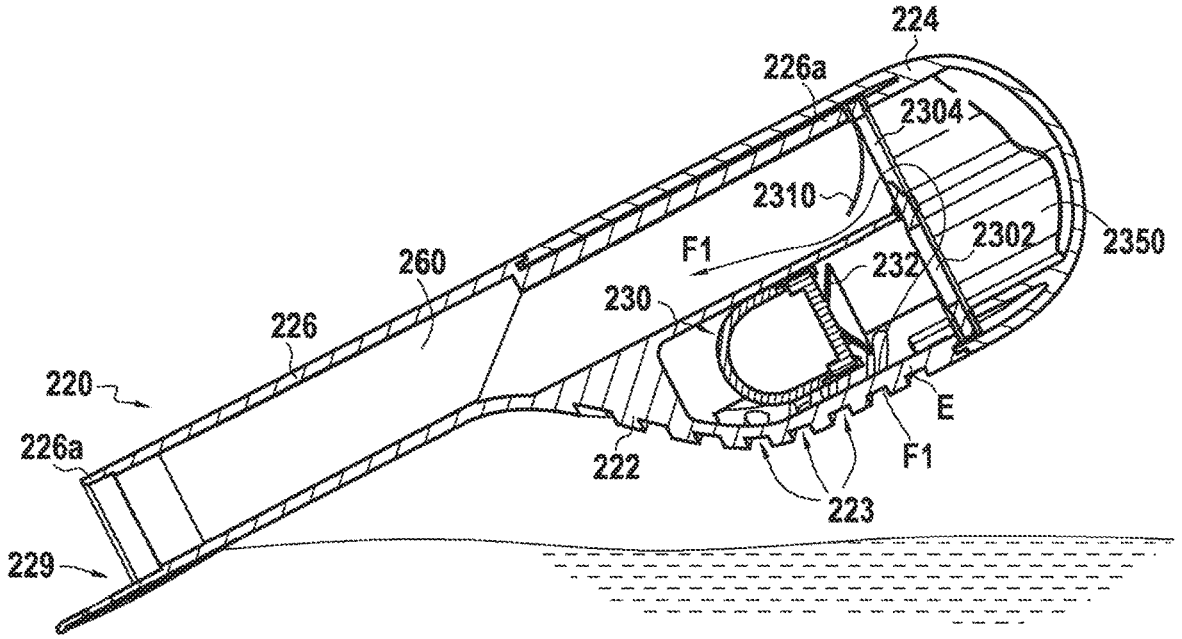
FIG. 19 illustrates the air inlet circuit in the breathing tube.

FIG. 19 illustrates the configuration of the breathing tube during an inspiration phase. It is understood that inspired fresh air illustrated by arrow F1 enters the cage 222 via the slots 223, then enters the fluid communication chamber 2350 via the main office 2302 then enters the inspired air intake channel 260 by passing through the inlet orifice 2304, the first check valve 2310 being open to let airflow through.

Figure 20:
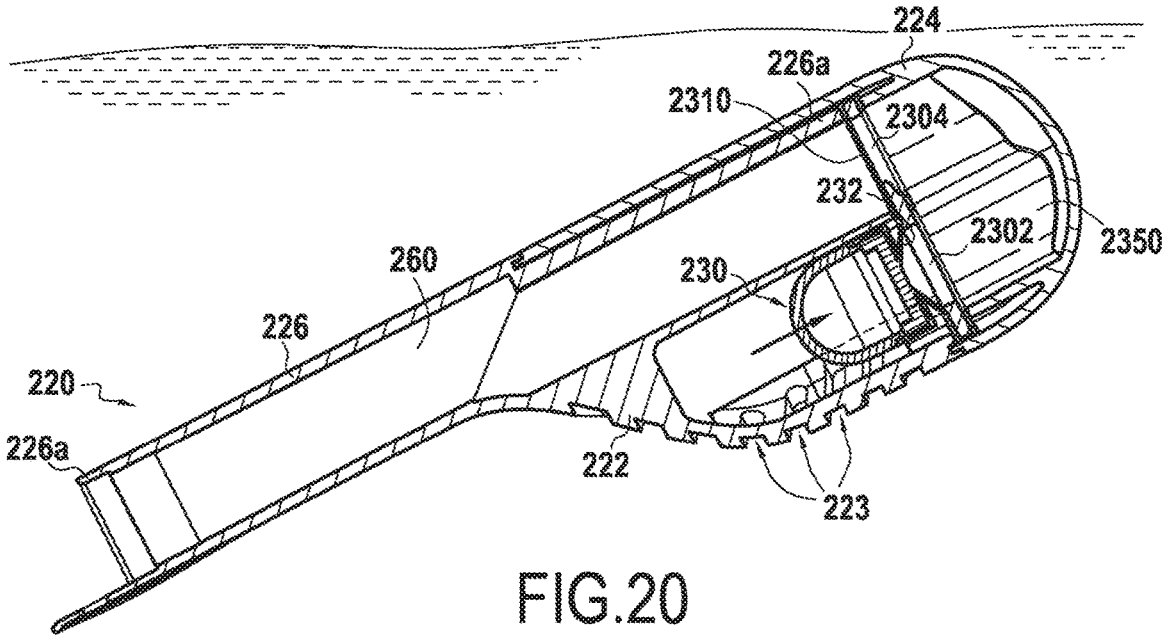
FIG. 20 illustrates the situation wherein the float blocks the entry of the breathing tube when the latter is immersed in water.

FIG. 20 illustrates the case where the breathing tube is immersed in water. The float 230, under the action of Archimedes thrust, rises in the cage 222 until the blocking device 232 blocks the main orifice 2302, the effect of which is to close the inlet of the breathing tube.

Figure 21:
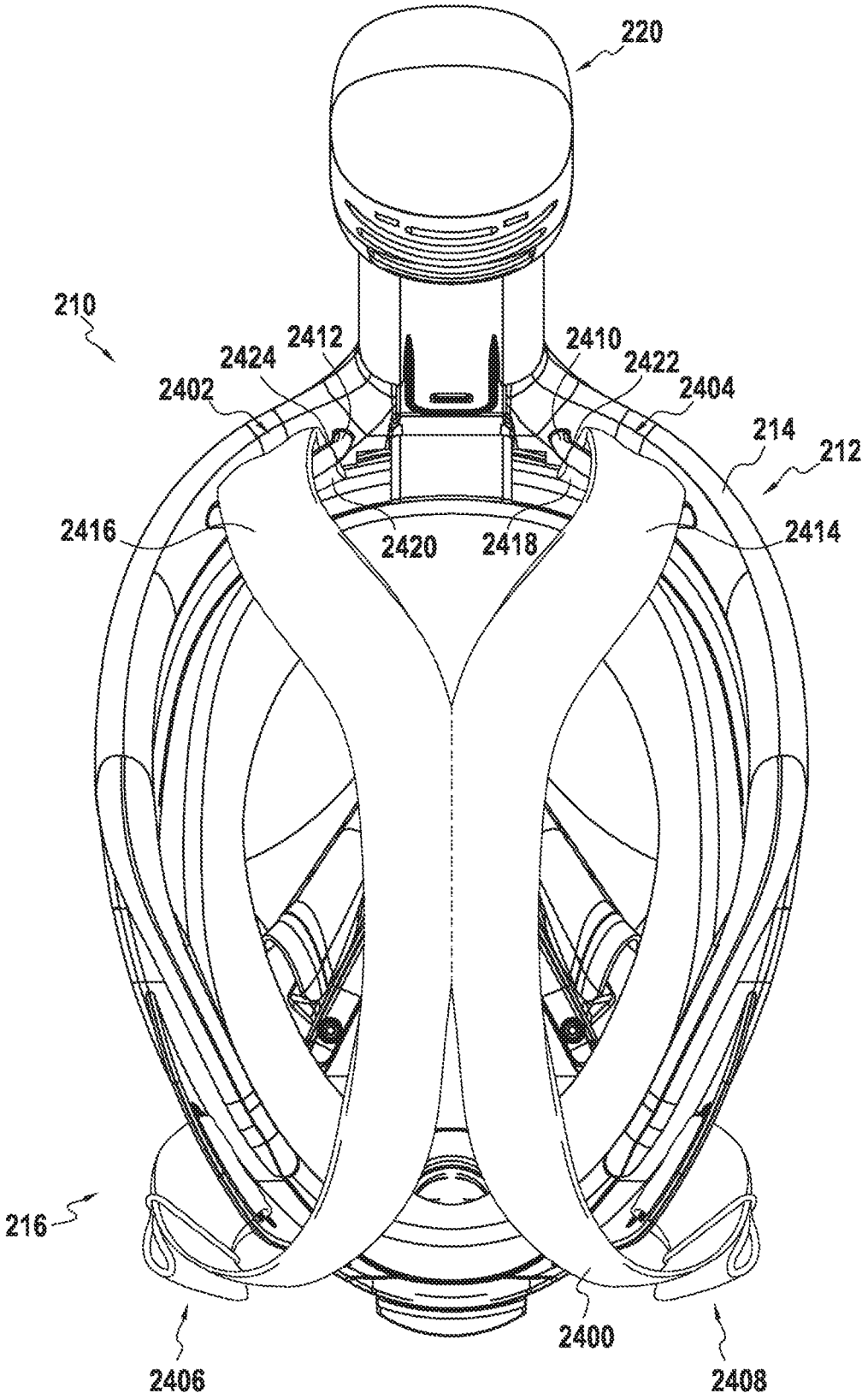
FIG. 21 is a rear view of the mask of FIG. 8, with the fastening strap.

As illustrated in the example of FIG. 21, the diving mask 210 further includes an elastic holding strap 2400 which extends between the upper portion 214 of the frame and the lower portion 216. The elastic strap 2400 includes two link points 2402, 2404 with the upper portion 214 and two link points 2406, 2408 with the lower portion 216. It is seen that the strap elastic forms a "X".

The upper portion 214 of the frame 212 also includes two loops 2410, 2412 wherein are engaged the ends of the two upper portions of the strap portions 2414, 2416. It is seen that the ends of these two strap portions 2414, 2416 form beads 2418, 2420 wider than the slots 2422, 2424 made in the loops, the effect of which is to ensure the elastic strap 2400 is held to the frame.

According to this first embodiment, the diving mask 210 further includes a telecommunications device 2500 which is also mounted to the breathing tube 220. In this way the diving mask 210 includes a detachable connector 600 arranged to be mounted to the breathing tube and the frame such that the detachable connector 600, when mounted to the breathing tube and the frame, forms a fluidic connection between the lower chamber 252 and the expired air exhaust channels 262, 264 of the breathing tube, and between the upper chamber 250 and the inspired air intake channel 260. As will be explained in detail hereinbelow, the detachable connector is detachable from the frame 212 and the breathing tube 220.

According to the third embodiment, the detachable connector 600 comprises the telecommunications device 2500.

Figure 22A:
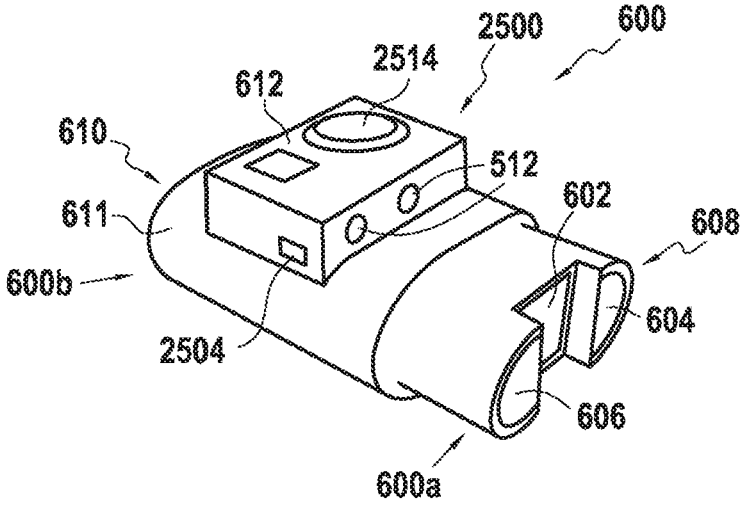
FIGS. 22A and 22B illustrate the telecommunications device and the detachable connector of the diving mask of FIG. 8.
Figure 22B:
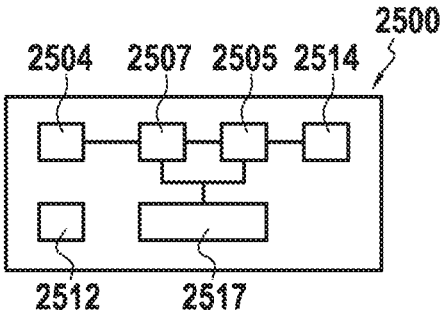

In the example of FIGS. 22A and 22B the telecommunications device 2500 comprises a loudspeaker 2514 which is housed in the detachable connector 600.

The telecommunications device 2500 further includes a transmitter module 2505 of a radio signal, and a receiver module 2507 of a radio signal.

In this example, the radio signal is a signal complying with "Bluetooth®" protocol, known elsewhere. The transmitter and receiver modules are therefore configured to transmit or receive radio signals according to this wireless transmission protocol. The loudspeaker 2514 is connected to the receiver module by a wire link, not shown here.

The telecommunications device includes an antenna 2517, which receives and transmits the radio signals. This antenna 2517 is connected to the transmitter 2505 and receiver 2507 modules. The telecommunications device 2500 further includes control buttons 2512 which are arranged, in this example, on the detachable connector.

The telecommunications device 2500 further includes a microphone 2504, connected to the transmitter module 2505. The microphone 2504 terminates in at least one of the ducts of the detachable connector, for example, in the inspired air exhaust duct.

When the detachable connector 600 is mounted to the frame 212 of the diving mask and the breathing tube 220, the telecommunications device 2500 is de facto mounted to the breathing tube 220.

More precisely, the detachable connector 600 is interleaved between the upper part 212*a* of the frame 212 and the breathing tube 220. As is evident from FIG. 8, the detachable connector is located at the proximal end of the breathing tube 20 when these two pieces are assembled with each other.

In reference to FIG. 22A, the detachable connector 600 includes an inspired air intake duct 602, and a first and a second expired air exhaust ducts 604, 606 which extend on either side of the inspired air intake duct 602. As mentioned hereinabove, without departing from the scope of the present disclosure, the detachable connector 600 can include a single duct when the breathing tube includes a single channel.

When the detachable connector 600, the breathing tube 220 and the frame 212 are mounted together, the inspired air intake duct 602 of the detachable connector 600 fluidically connects the inspired air intake channel 260 of the breathing tube 220 to the upper chamber 250, while the first and second expired air exhaust ducts 604, 606 of the detachable connector 600 fluidically connect the lower chamber 252 to the first and second expired air exhaust channels 262, 264 of the breathing tube 220.

The detachable connector 600 includes a first end 600*a* configured to cooperate with the proximal end 220*a* of the breathing tube, and a second end 600*b* which is shaped to cooperate with the extension 228 of the upper portion of the frame 212.

More precisely, it is understood by means of FIG. 14 that when the detachable connector is fixed to the frame 212 and the breathing tube 220, the inspired air intake duct 602 of the detachable connector is fluidically connected to the central channel 270 of the extension 228, while the first and second expired air exhaust ducts 604, 606 are fluidically connected to the expiration channels 272, 274.

To ensure fastening of the detachable connector 600 to the frame 212 and the breathing tube 220, the breathing tube 220 includes a fastening member 229, seen in FIG. 9. The frame 12 includes a fastening device, here constituted by the extension 228 illustrated in FIG. 14, arranged so it can be detachably coupled to the fastening member 229 of the breathing tube so it can form a sealed connection between the breathing tube and the frame.

The detachable connector 600 further includes a first fastening part 608, located at the first end 600*a*, arranged to be detachably fixed with the fastening member 229 of the breathing tube 220. The first fastening part 608 is shaped to nest in the fastening member 229 of the breathing tube 220.

The detachable connector 600 includes a second fastening part 610 arranged so it can be detachably fixed with the fastening device 228 of the frame 212. As is understood by means of FIGS. 14 and 24, the fastening device 228 of the frame 212 is shaped to fit inside the second fastening part 610.

This arrangement makes for a first sealed connection between the breathing tube 220 and the detachable connector 600, and a second sealed connection between the frame and the detachable connector.

It is understood that it is also possible to directly connect the breathing tube 220 to the frame 212 of the mask, as is illustrated in FIG. 16, for example when the aim is not to utilise the telecommunications device.

The detachable connector 600 includes a body 611 fitted with a housing 612 which receives the loudspeaker 2514, the transmitter module, the receiver module, the microphone and the antenna. The detachable connector further includes a battery and control buttons 512.

Figure 23:
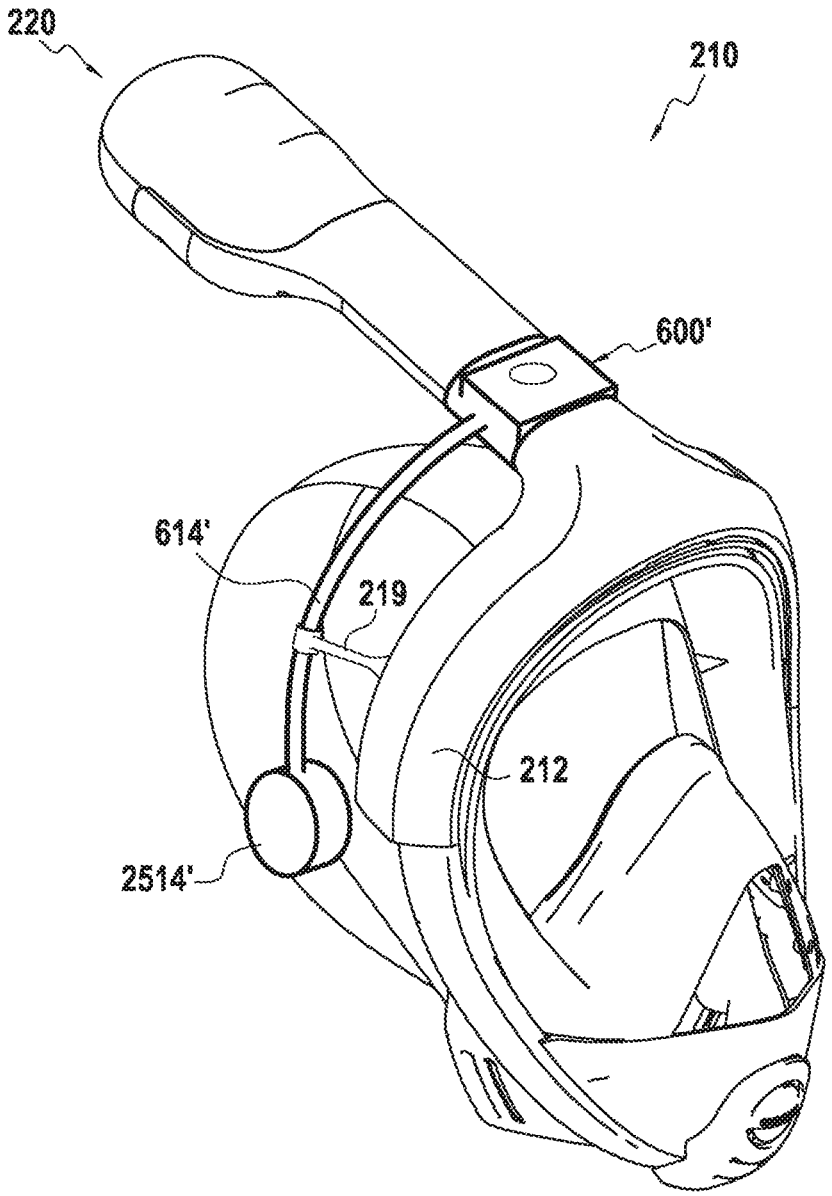
FIG. 23 illustrates a variant of the detachable connector of FIG. 8.

FIG. 23 illustrates a variant of the detachable connector 600' according to the disclosure. The detachable connector 600' of FIG. 23 differs from the detachable connector 600 of FIG. 22A by the fact that the loudspeaker 2514' is shifted and is connected to the detachable connector 600' by a linking arm 614' which laterally extends relative to the frame 212. As is understood by means of FIG. 23, the shifted loudspeaker 2514' is located facing the ear of the user, which substantially improves the hearing quality.

To improve the hold of the linking arm 614' during snorkelling, the frame 212 includes a fastening element 219 for fastening the linking arm 614' to the frame 212. This fastening element 219, shown in FIG. 23, is an extension of the strapping of the frame of the mask. It is specified here that this configuration of shifted loudspeaker can also be implemented in the first and second embodiments of the diving mask described hereinabove.

Figure 24A:
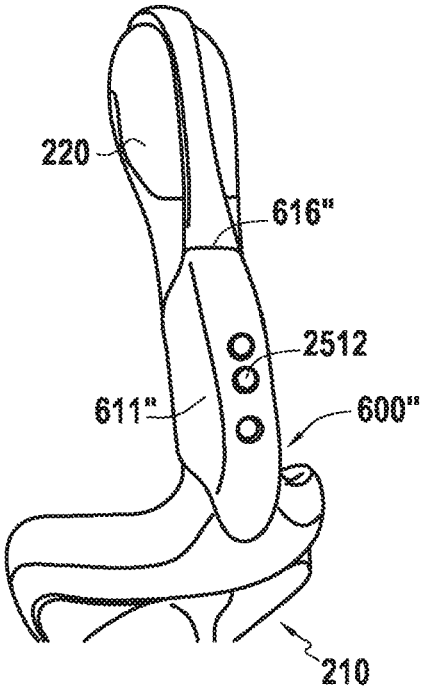
FIGS. 24A and 24B illustrate another variant of the detachable connector of FIG. 8.
Figure 24B:
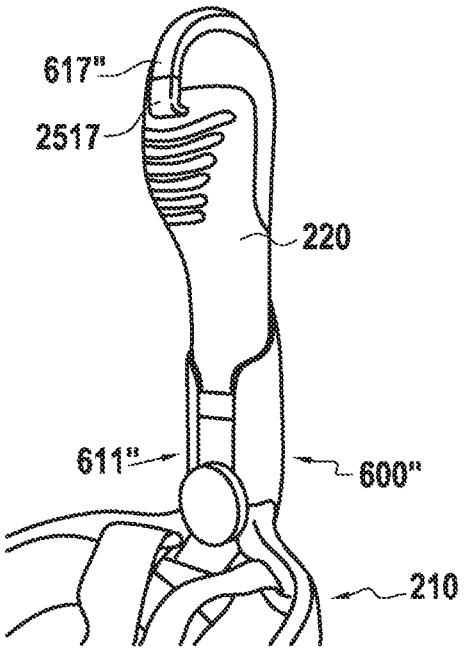

FIGS. 24A and 24B illustrate another variant of the detachable connector 600" according to the disclosure. The detachable connector 600" illustrated in FIGS. 24A and 24B differs from the detachable connector 600 of FIG. 22A by the fact that the antenna is not arranged in the housing of the detachable connector, but at the distal end 220*b* of the breathing tube 220 when the latter is fixed to the detachable connector 600".

To do this, the detachable connector includes a joining element 616" which projects from the body 611" of the detachable connector 600" so as to extend along the breathing tube 220 when the latter is fixed to the detachable connector 600". The joining element 616" receives the antenna 2517 at its distal end 617". As is evident by means of FIG. 24B, the distal end 617" of the joining element 616" is shaped to be fixed to the distal end 220*b* of the breathing tube. In this example, fastening is realised by the fact that the distal end 617" of the joining element made of flexible material forms a hook whereof the end cooperates with the slots 223 made in the cage 222 of the breathing tube 220.

As is evident from FIG. 24A, the telecommunications device further includes control buttons 2512 arranged on the body 611" of the detachable connector.

Figure 25A:
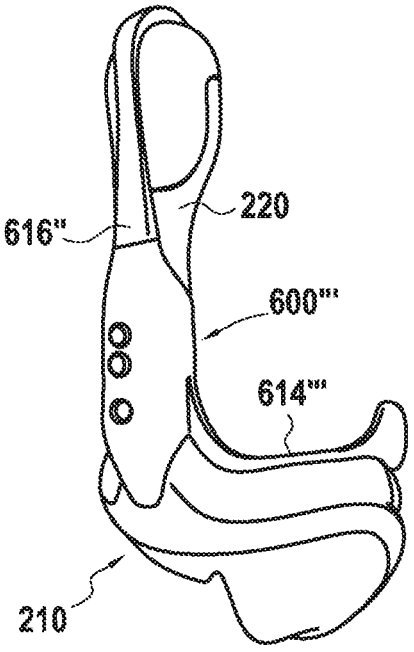
FIGS. 25A and 25B illustrate a variant of the detachable connector of FIG. 24A.
Figure 25B:
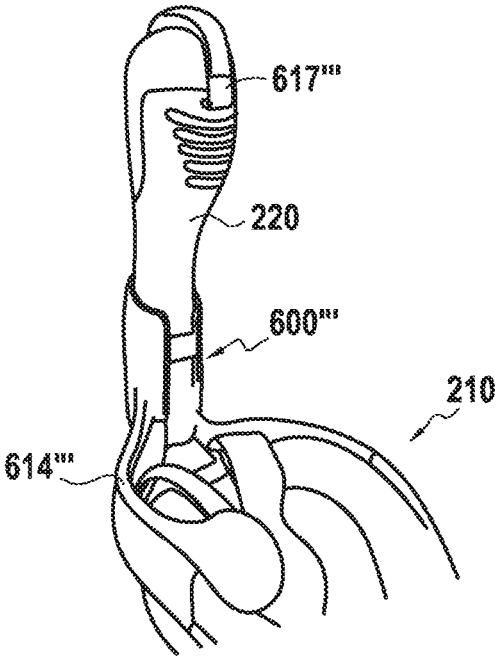

FIGS. 25A and 25B illustrate a variant of the detachable connector 600" according to the disclosure. The detachable connector 600" of FIGS. 25A and 25B differs from that of FIGS. 24A and 24B by the fact that the loudspeaker is laterally shifted, as for the variant of FIG. 23.

FIGS. 26 and 27 illustrate a case 1509 for a microphone configured to be mounted, for example and non-limiting, on a breathing tube 120 such as illustrated in FIGS. 6A to 6C.

As is evident from the exploded view of FIG. 26, the case 1509 includes a body 1511 defining a housing wherein the microphone 1504 is disposed. The case further includes a face 1515 configured to cover the opening of the housing defined by the body.

Furthermore, the case 1509 includes a damper block 1521, for example formed from material of foam type, disposed between the microphone 1504 and the face 1515.

The body 1511 also includes sealing means 1519, 1519' which comprise, for example and non-limiting, two sealing lips annularly extending around the body 1511.

FIG. 27 illustrates the assembly of the case 1509 on the breathing tube 120.

The breathing tube 120 includes a wall 127 wherein an orifice 129 is formed. For example and non-limiting, the orifice 129 is formed in the wall opposite that on which the loudspeaker 1514 is mounted.

The case 1509 is mounted on the wall 127 by extending through the orifice 129 such that the face 1515 is disposed inside the tube 120; in other words, the face 1515 of the case 1509 leads in the channel 121 of the breathing tube 120; the sealing means 1519, 1519' are thus configured to ensure sealing between the wall 127 and the case 1509, the sealing lips coming into contact with the two opposite faces of the wall 127. It is clear that the case 1509 is thus housed in the thickness of material forming the wall 127.

The case 1509 prevents the microphone 1504 from being exposed to water, which would compromise its operation.

So that the case 1509 does not compromise the quality of the signal sensed by the microphone 1504, the face 1515 has minimum thickness and is formed from material of silicone type. Furthermore, to ensure propagation of sound between the face 1515 and the microphone 1504, sufficient volume between said elements is provided into the housing of the case 1509.

The body 1511 is formed from elastic material such as silicone and has a thickness configured to reduce vibrations generated by the breathing tube 120; the thickness of the body 1511 may be greater than that of the face 1515. Thickness of the body 1511 means the thickness of the different walls constituting the body 1511.

The body 1511 also has a face 1523 disposed outside the tube 120; for example and non-limiting, the face 1523 of the body 1511 includes elastic material such as silicone adhesive so as to participate for the hermetic sealing of the housing and contribute to reducing vibrations generated by the breathing tube 120.

The presence of the damper block 1521 also participates to the vibration damping emitted by the breathing tube 120.

In this way the case 1509 receiving the microphone 1504 and mounted in the wall of the breathing tube 120 both protects the microphone from humidity and filters mechanical vibrations emitted by the breathing tube 120.

The invention claimed is:

1. A diving mask including:

a frame fitted with a visor, a flexible skirt including a partition delimiting an upper chamber for viewing from a lower chamber for breathing, the partition being arranged to bear upon the nose of the user such that the mouth and the nose of the user are in the lower chamber, while the eyes of the user are in the upper chamber, the partition including at least one passageway for enabling circulation of inspired air directed from the upper chamber towards the lower chamber during an inspiration phase of the user;

a breathing tube having a proximal end for linking the breathing tube to the frame, and a distal end opposite the proximal end, said distal end having an air inlet for exchanging air with the atmosphere, the breathing tube including at least one air channel fluidly connected with the lower chamber;

wherein the diving mask further includes a telecommunications device which is mounted at least partially to the breathing tube, said telecommunications device comprising a microphone which is mounted to the breathing tube and terminates in said channel fluidly connected with the lower chamber.

2. The diving mask according to claim 1, wherein the telecommunication device further comprises a loudspeaker at the proximal end of the breathing tube.

3. The diving mask according to claim 1, wherein the breathing tube includes a wall wherein an orifice is formed, wherein the microphone is housed in a case, said case being mounted to the wall of the breathing tube by extending through the orifice, the case comprising a face disposed inside the air channel.

4. The diving mask according to claim 1, wherein the microphone is at the proximal end.

5. The diving mask according to claim 1, wherein the telecommunications device further comprises an antenna at the distal end of the breathing tube.

6. The diving mask according to claim 1, wherein at least one part, the telecommunication device frame part, of the telecommunications device is mounted to the frame.

7. The diving mask according to claim 6, wherein the telecommunication device frame part comprises a control button of the telecommunications device.

8. The diving mask according to claim 6, wherein the telecommunication device frame part includes at least one loudspeaker which is connected to the frame by a linking arm.

9. The diving mask according to claim 1, wherein the breathing tube forms one and the same piece with the frame.

10. The diving mask according to claim 1, wherein the breathing tube is detachable from the frame, and wherein the breathing tube includes the telecommunications device.

11. The diving mask according to claim 1, wherein the breathing tube has an inspired air intake channel and at least one first expired air exhaust channel, such that when said breathing tube is fluidly connected with the frame, the inspired air intake channel is fluidly connected with the upper chamber, while the first expired air exhaust channel is fluidly connected with the lower chamber.

12. The diving mask according to claim 1, wherein the telecommunications device comprises transmitter and receiver modules, and a loudspeaker.

13. The diving mask according to claim 1, wherein the breathing tube has a body to which is mounted the microphone, and wherein telecommunications device comprises at least a loudspeaker shifted relative to the body of the breathing tube so as to be placed near at least one of the ears of the user.

14. A diving mask including:

a frame fitted with a visor;

a flexible skirt including a partition delimiting an upper chamber for viewing from a lower chamber for breathing, the partition being arranged to bear upon the nose of the user such that the mouth and the nose of the user are in the lower chamber, while the eyes of the user are in the upper chamber, the partition including at least one passageway for enabling circulation of inspired air directed from the upper chamber towards the lower chamber during an inspiration phase of the user, a breathing tube having a proximal end for linking the breathing tube to the frame, and a distal end opposite the proximal end, said distal end having an air inlet for exchanging air with the atmosphere;

the breathing tube including at least one air channel fluidly connected to the lower chamber;

wherein said diving mask further includes a detachable connector arranged to be mounted between the breathing tube and the frame, such that the detachable connector, when mounted to the breathing tube and the frame, forms a fluidic connection at least between the lower chamber and the channel of the breathing tube, the detachable connector being detachable from the frame and the breathing tube, and wherein the detachable connector includes a telecommunications device comprising a microphone, a loudspeaker as well as transmitter and receiver modules.

15. The diving mask according to claim 14, wherein the loudspeaker is housed in the detachable connector.

16. The diving mask according to claim 14, wherein the loudspeaker is shifted from the detachable connector so as to be disposed facing one of the ears of the user.

17. The diving mask according to claim 16, wherein the frame includes a fastening element for holding the shifted loudspeaker.

18. The diving mask according to claim 16, wherein the detachable connector includes a linking arm supporting the shifted loudspeaker, the linking arm extending according to a lateral side of the diving mask.

19. The diving mask according to claim 14, wherein the telecommunications device includes an antenna which is disposed in a joining element configured to extend along the breathing tube, said joining element having an end arranged to be fixed to the distal end of the breathing tube.

20. The diving mask according to claim 14, wherein the breathing tube includes a fastening member, while the frame includes a fastening device arranged to be able to be detachably fixed to the fastening member of the breathing tube so as to be able to form a sealed connection between the breathing tube and the frame, and wherein the detachable connector includes a first fastening part arranged to be detachably fixed with the fastening member of the breathing tube, and a second fastening part arranged to be able to be detachably fixed with the fastening device of the frame, so as to be able to form a first sealed connection between the breathing tube and the detachable connector, and a second sealed connection between the frame and the detachable connector.

21. The diving mask according to claim 14, wherein the detachable connector includes an inspired air intake duct and at least one first expired air exhaust duct, and wherein when the detachable connector, the breathing tube and the frame are mounted together, the inspired air intake duct of the detachable connector fluidly connects the inspired air intake channel of the breathing tube to the upper chamber, while the first expired air exhaust duct of the detachable connector fluidly connects the lower chamber to the first expired air exhaust channel.

22. A detachable connector of a diving mask with a breathing tube, wherein the detachable connector comprises:

a body having a breathing tube detachable fastening portion;

a telecommunications device having:

a shifted loudspeaker linked to the body with a linking arm, a microphone, an antenna, at least a control button, and transmitter and receiver modules.

23. A detachable breathing tube device of a diving mask, wherein the detachable breathing tube device includes;

a body having;

a proximal end part comprising a fastening part for its detachable fastening to the frame of the diving mask, a distal end part, opposite to the proximal end part;

an air inlet with orifices for exchange air with the atmosphere;

at least one air channel connected to the air inlet;

a telecommunications device mounted to the body and comprising a loudspeaker, a microphone, an antenna as well as transmitter and receiver modules, wherein the microphone is mounted to the body and the antenna is at the distal end part of the body.

24. The detachable breathing tube device according to claim 23, wherein the microphone terminates in the air channel.

25. The detachable breathing tube device according to claim 23, wherein the telecommunications device further comprises a control button located on a first body wall, opposite to a second body wall comprising the orifices of the air inlet.

26. A diving mask including:

a frame fitted with a visor;

a flexible skirt including a partition delimiting an upper chamber for viewing from a lower chamber for breathing, the partition being arranged to bear upon the nose of the user such that the mouth and the nose of the user are in the lower chamber, while the eyes of the user are in the upper chamber, the partition including at least one passageway for enabling circulation of inspired air directed from the upper chamber towards the lower chamber during an inspiration phase of the user; and a breathing tube having a proximal end for linking the breathing tube to the frame, and a distal end opposite the proximal end, the breathing tube including at least one air channel fluidly connected with the lower chamber, said distal end having an air inlet for exchanging air with the atmosphere;

wherein the diving mask further comprises a detachable connector which is mounted detachably to the breathing tube, the detachable connector comprising a telecommunications device having an antenna, a loudspeaker, a microphone as well as transmitter and receiver modules.

27. The diving mask according to claim 26, wherein the antenna is at the distal end of the breathing tube.

28. The diving mask according to claim 26, wherein the loudspeaker is shifted relative to the body of the breathing tube so as to be placed near at least one of the ears of the user.

29. The diving mask according to claim 28, wherein the loudspeaker is linked by a linking arm to a detachable connector body of the detachable connector.

30. The diving mask according to claim 26, wherein the detachable connector has a clip portion to be detachably clipped to the breathing tube.

31. A diving mask including:

a frame fitted with a visor, a flexible skirt including a partition delimiting an upper chamber for viewing from a lower chamber for breathing, the partition being arranged to bear upon the nose of the user such that the mouth and the nose of the user are in the lower chamber, while the eyes of the user are in the upper chamber, the partition including at least one passageway for enabling circulation of inspired air directed from the upper chamber towards the lower chamber during an inspiration phase of the user, a breathing tube having a proximal end part for linking the breathing tube to the frame, and a distal end part opposite the proximal end, the breathing tube having at least one channel fluidly connected to the lower chamber, said distal end part having an air inlet for exchanging air with the atmosphere, wherein the diving mask further comprises:

a telecommunications device which comprises at least a loudspeaker, a microphone, an antenna as well as transmitter and receiver modules, said loudspeaker being shifted relative to the body of the breathing tube so as to be placed near at least one of the ears of the user;

a detachable element detachably fastened to the breathing tube, said detachable element comprising at least said antenna, said microphone as well as said transmitter and receiver modules; and a linking arm for linking the loudspeaker to the detachable element.

32. The diving mask according to claim 31, wherein the antenna is at the distal end part of the breathing tube.

33. The diving mask according to claim 31, wherein the detachable element comprises at least a control button for controlling the telecommunication device.

* * * * *